US005384173A

United States Patent [19]

Akao et al.

[11] Patent Number: 5,384,173

[45] Date of Patent: Jan. 24, 1995

[54] CONTAINER FOR PHOTOGRAPHIC FILM, ITS PRODUCTION AND PHOTOGRAPHIC FILM PACKAGE

[75] Inventors: Mutsuo Akao; Koji Inoue, both of Kanagawa, Japan

[73] Assignee: Fuji Photo Film Co., Ltd., Kanagawa, Japan

[21] Appl. No.: 57,846

[22] Filed: May 7, 1993

[30] Foreign Application Priority Data

May 8, 1992 [JP] Japan ..... 4-115055

[51] Int. Cl.[6] ..... G03C 3/00

[52] U.S. Cl. ..... 428/35.7; 428/156; 428/163; 220/669; 220/675; 220/676; 220/674

[58] Field of Search ..... 428/35.7, 36.92, 156, 428/163; 206/407, 389, 524.6; 220/669, 675, 676, 674

[56] References Cited

U.S. PATENT DOCUMENTS 4,844,961 7/1989 Akao ..... 428/36.92

5,106,665 4/1992 Akao et al. ..... 428/36.92

OTHER PUBLICATIONS

Japanese Abstract No. 63-193142, "Case Body for Photographic Film Cartridge", Mutsuo Akao Aug. 10, 1988, vol. 12, No. 477 (P-800) (3324), Dec. 14, 1988.

*Primary Examiner*—Charles R. Nold
*Attorney, Agent, or Firm*—Sughrue, Mion, Zinn, Macpeak & Seas

[57] ABSTRACT

A container for a photographic film wherein the container body is made of a thermoplastic resin and a roughened face having a height of 0.001 to 5 μm is formed on the inner peripheral wall portion, and a container for a photographic film, container for a photographic film can be produced without the occurrence of bursting pop sound, bottom sink mark and buckling, small decreae of impact strength and transparency, is excellent in wear resistance and slipping character, and can shorten molding cycle.

16 Claims, 7 Drawing Sheets

FIG.1
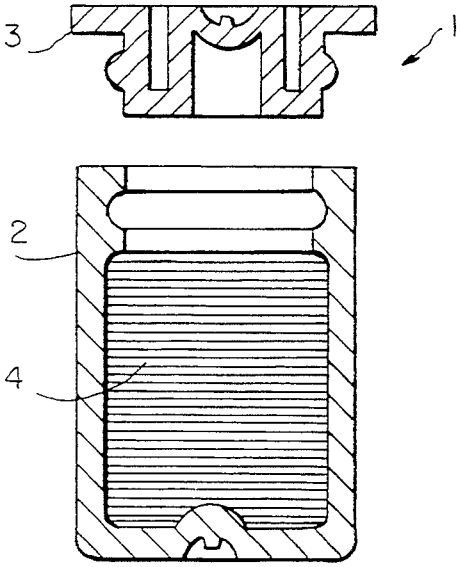
FIG.2
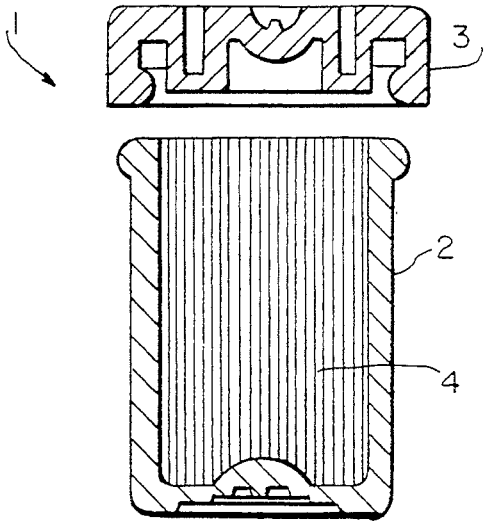
FIG.3
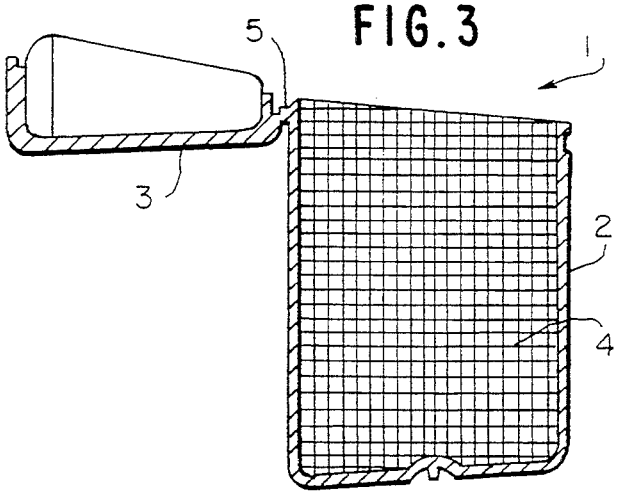
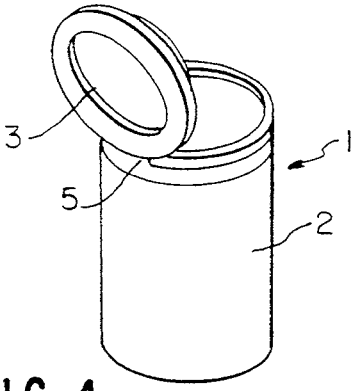
FIG.4
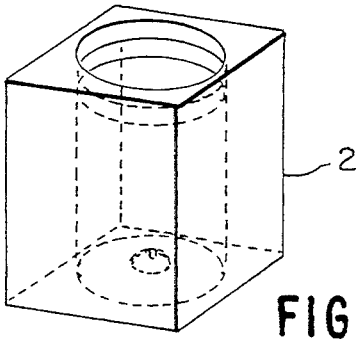
FIG.5

FIG. 6
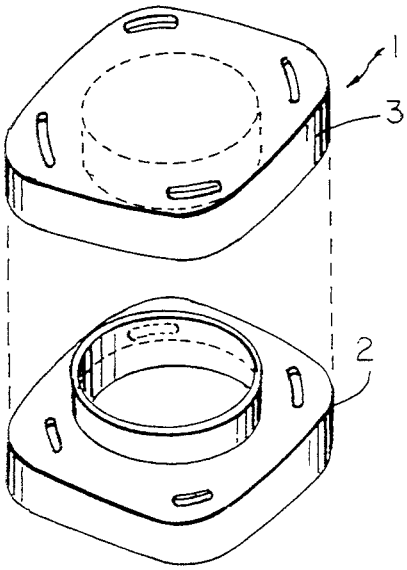
FIG. 7
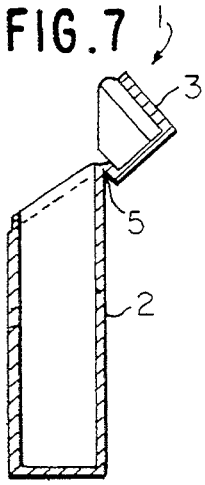
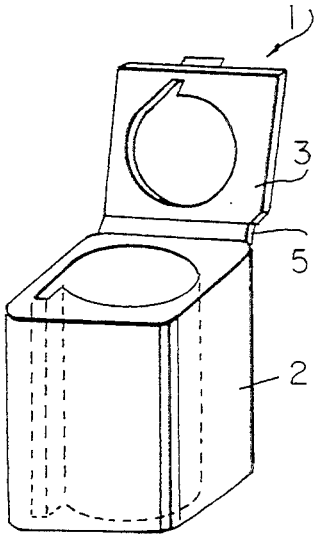
FIG. 8
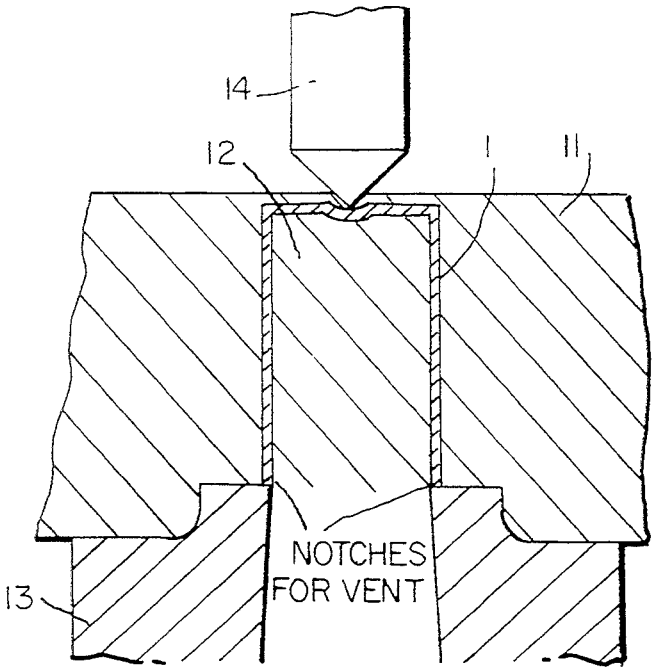
FIG. 9
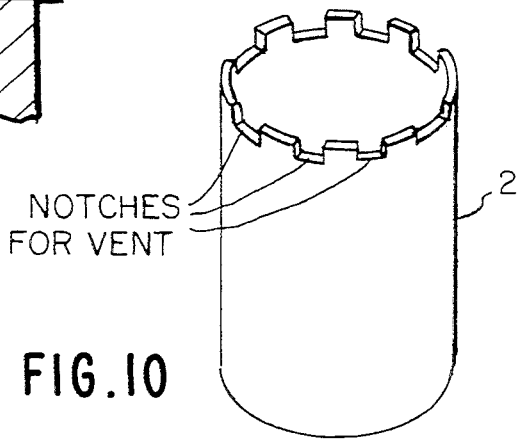
FIG. 10

FIG. 18
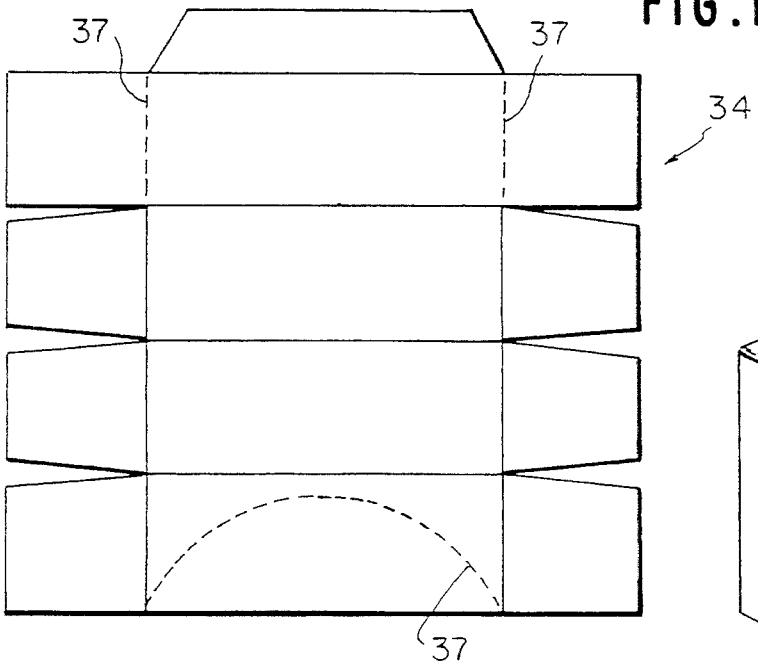
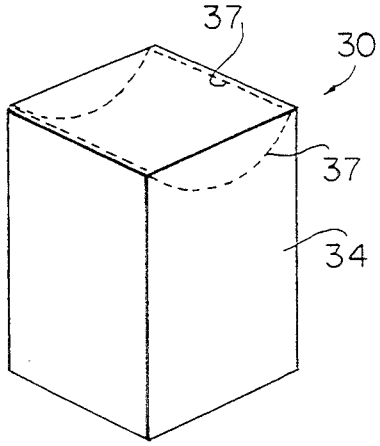
FIG. 19
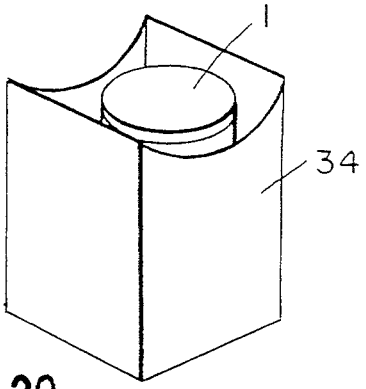
FIG. 20
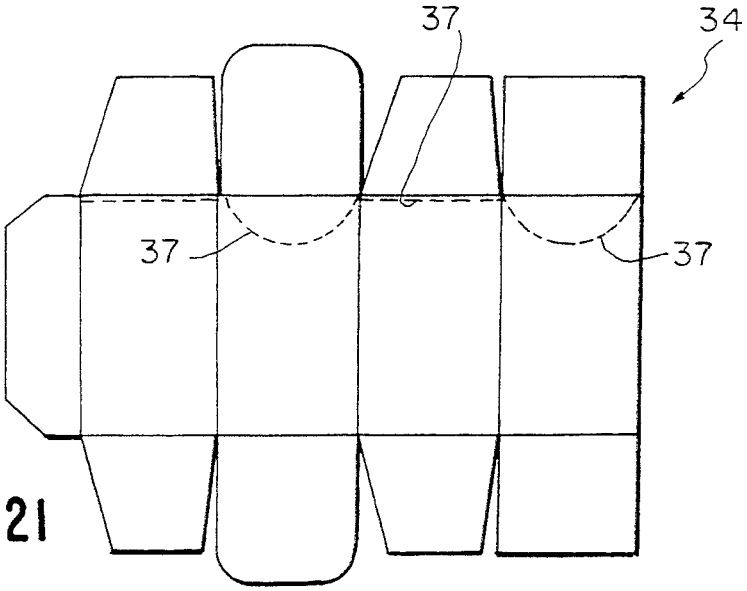
FIG. 21

FIG. 25
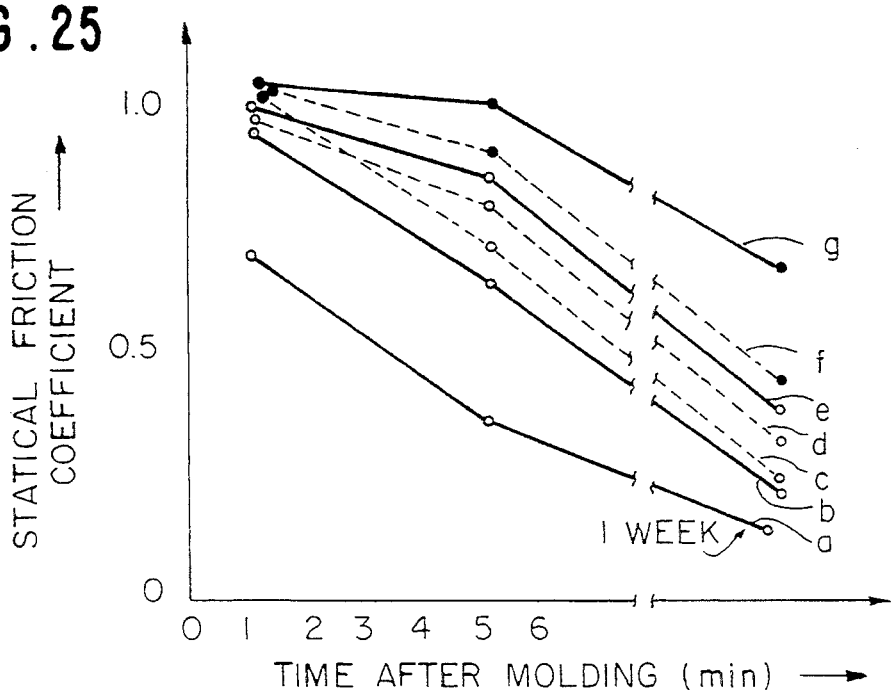
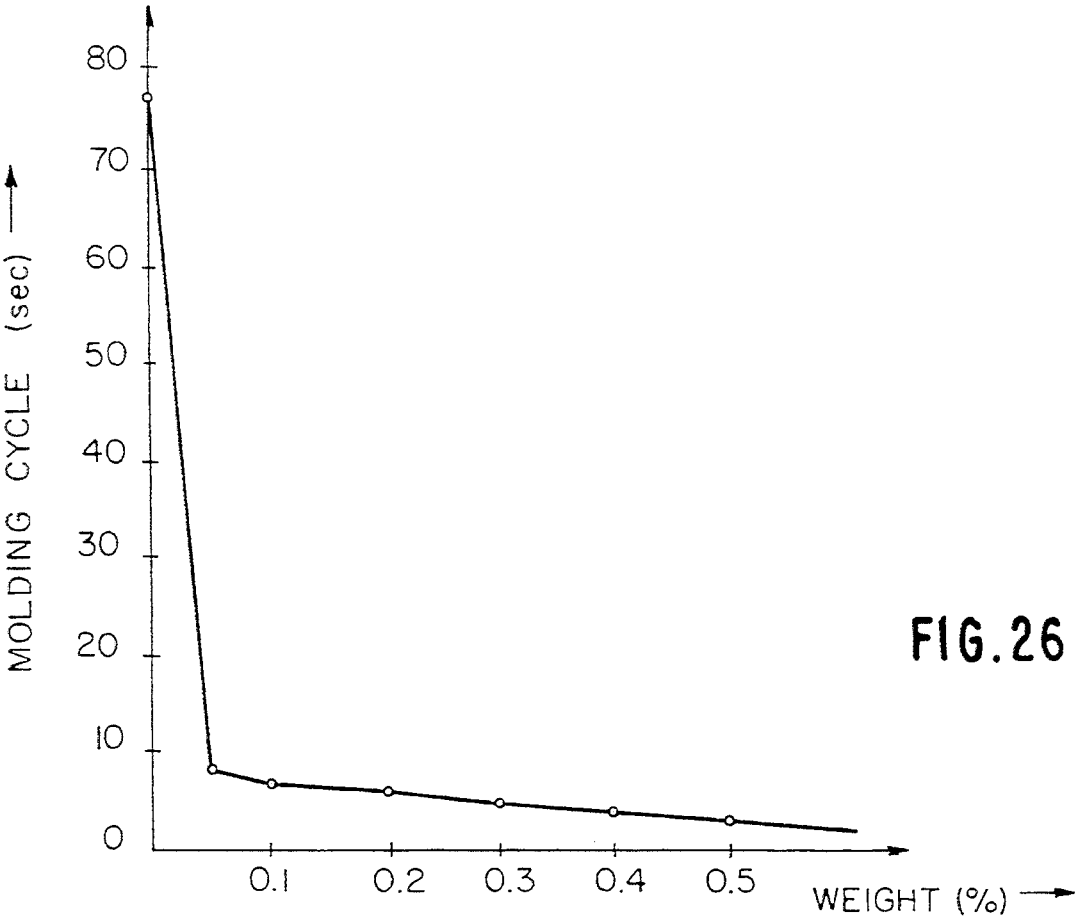
FIG. 26

CONTAINER FOR PHOTOGRAPHIC FILM, ITS PRODUCTION AND PHOTOGRAPHIC FILM PACKAGE

BACKGROUND OF THE INVENTION

This invention relates to a container for containing a photographic film in a sealed state, a method of molding the container continuously, and a photographic film package using the container.

The inventor found that, when the peripheral wall portion is formed smooth, the inside of the container body has reduced pressure conditions the mold core is removed. As a result, when the mold core is taken out prior to the container body being completely solidified, a bursting pop sound, a bottom sink mark (a deformation of the bottom portion toward the inside of the container body), or buckling (which is warping of the peripheral wall portion towards the inside) occur. Accordingly, in order to avoid the occurrence of defective units, it is necessary to extend cooling time up to the temperature of container body lower than 20° C. before the mold core is taken out. As a result, the molding cycle becomes long.

Thereupon, there was proposed a container body for a photographic film cartridge wherein at least the bottom third of the inner surface is roughened with a depth of more than 7 μm (Japanese Patent KOKAI No. 63-193142). In the container body, the occurrence of the bursting pop sound, a bottom sink mark, and buckling can be avoided. However, it has problems in the reduced impact strength and transparency, in insufficient wear resistance and slipping character, and generation of powders of light-shielding material by abrasion or releasing.

SUMMARY OF THE INVENTION

An object of the invention is to provide a container for a photographic film which can be produced without the occurrence of a bursting pop sound, a bottom sink mark, or buckling, which has a small decrease of impact strength and transparency, which is excellent in wear resistance and slipping character, and which can shorten molding cycle.

The present invention provides a container for a photographic film which has achieved the above object, comprising a container body being made of a thermoplastic resin having a roughened face 0.001 to 5 μm in height of roughness on the inner peripheral wall portion.

BRIEF DESCRIPTION OF THE DRAWINGS

FIGS. 1 through 3 and 7 are sectional views of some containers for a photographic film embodying the invention, respectively.

FIGS. 4 through 6 and 8 are perspective views of some other containers for a photographic film embodying the invention, respectively.

FIG. 9 is a partial sectional view of a molding apparatus for forming a container for a photographic film of the invention.

FIG. 10 is a perspective view of the container body formed by the molding apparatus shown in FIG. 9.

FIGS. 12, 13, 16, 19, 22 through 24 are perspective views of some packages for a photographic film embodying the invention, respectively.

FIG. 18 is a development of the packaging box of the package for a photographic film of FIG. 16.

FIG. 20 is a perspective view of the package for a photographic film of FIG. 19 in an opened state, and FIG. 21 is a development of the packaging box of the package for a photographic film of FIG. 19.

FIG. 25 is a graph indicating a relationship between the kind and blending amount of lubricant and statical friction coefficient of a container body for a photographic film.

FIG. 26 is a graph indicating a relationship between blending amount of oleic amide lubricant and moldability in the case of molding a cap of a container for a photographic film.

Figure 11:
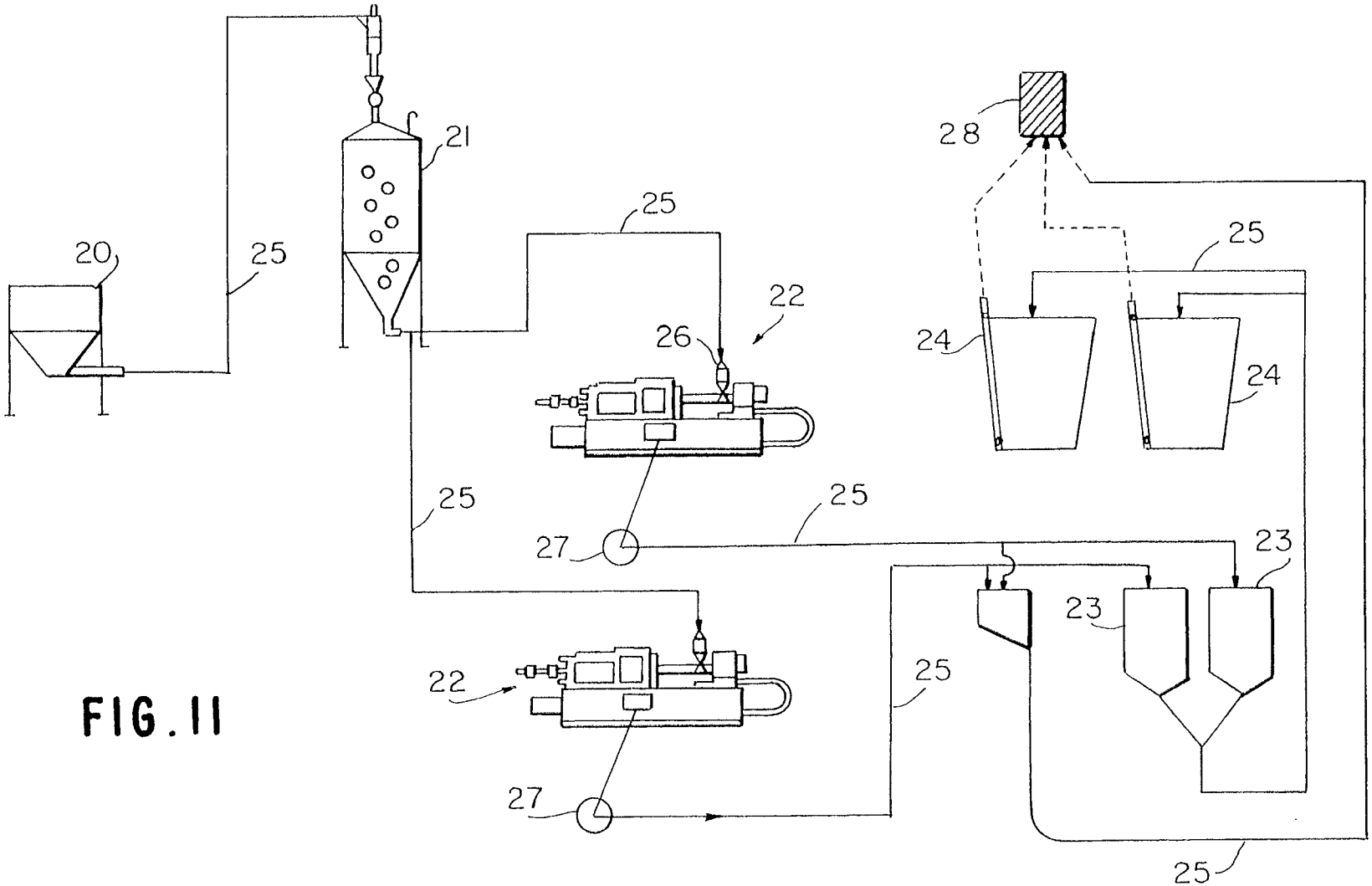
FIG. 11 is a flow diagram illustrating a conveying method of resin for forming the container for a photographic film of the invention.

1 . . . Container for a photographic film
2 . . . Container body
3 . . . Cap
4 . . . Roughened face
20 . . . Container
21 . . . Silo
22 . . . Molding machine
25 . . . Pneumatic conveying pipe
30 . . . Package of a photographic film
31 . . . Wrapping film
34 . . . Casket for packaging
38 . . . Band sealing

DETAILED DESCRIPTION OF THE INVENTION

The form of the roughness is composed by many lateral fine ribs formed in the circumferential direction, many longitudinal fine ribs formed in the axial direction, lattice fine ribs form, silk cloth finish form, aventurine finish form, or the like. The form of the roughness may be any form capable of preventing reduced pressure in the container body at the time the core is extracted therefrom.

A suitable distance between adjacent fine ribs is 0.1 to 1,000 μm, preferably 0.5 to 500 μm, more preferably 1 to 200 μm. A suitable height of fine ribs is 0.001 to 5 μm, preferably 0.005 to 2.5 μm, more preferably 0.01 to 1 μm. When the height is smaller than 0.001 μm, bursting sound is great, and buckling, bottom sink mark and the like are liable to occur. When the height is greater than 5 μm, impact strength greatly decreases, and transparency degrades. Moreover, slipping character is inferior, and abrasion powder is liable to be generated.

As a method of forming the roughened face, in the case of the inner surface of the peripheral wall portion of the container body, indentations are formed on the surface of the core mold (male mold), by the sandblasting method, the etching method, the engraving method, the grinding method or the like. In the case of the outer surface of the peripheral wall portion of the container body, indentations are formed on the surface of the cavity (female mold) by the method similar to the core mold. In order to form very fine indentations as above, it is preferable that the surface of the core mold is first formed into a smooth surface, and then the indentations are formed thereon by using a grinding paper, grinding cloth or the like. When many lateral fine glooves are formed in the circumferential direction, grinding paper, grinding cloth or the like is pressed to the peripheral surface of the core mold in a form of cylinder including circular cylinder and elliptic cylinder or prism including square cylinder and polygonal cylinder, and then the core is rotated. Alternatively, the grinding paper, grinding cloth or the like may be moved on the surface of the core which is fixed in the circumferential direction. When many longitudinal fine grooves are formed in the axial direction, the grooves can be formed easily by changing the movement in the above circumferential direction to the movement in the axial direction. When lattice fine grooves are formed, the grooves can be formed easily by combining the movement in the above circumferential direction and the movement in the axial direction. The movement may be in an oblique direction, or the like.

As the thermoplastic resin for forming the container for a photographic film of the invention, there are ethylene-copolymer resins, homopolyethylene resins, homopolypropylene resins, propylene copolymer resins, vinyl chloride resins, and the like. When the container is transparent, preferable resins are homopolyethylene resins having a density of not less than 0.935 g/cm$^3$, preferably not less than 0.945 g/cm$^3$, more preferably not less than 0.955 g/cm$^3$, particularly preferably not less than 0.960 g/cm$^3$ and ethylene-α-olefin copolymer resins containing 0.01 to 2 wt. % of nucleating agent, particularly preferably the above ethylene-α-olefin random copolymer resins wherein the number of the carbon atoms of the olefin is 3 to 10 and propylene-ethylene random copolymer resins containing 0.01 to 2 wt. % of nucleating agent. When the container is colored into white, black or the like, preferable resins are homopolyethylene resins having a density of not less than 0.935 g/cm$^3$, preferably not less than 0.945 g/cm$^3$, more preferably not less than 0.955 g/cm$^3$, and propylene-ethylene block copolymer resins. The main resin contained in an amount of more than 50 wt. % of the container is selected from these resins.

Various polypropylene resins (homopolymer, random copolymer or block copolymer) are usable for the purpose of the improvement in physical strength, in the dispersibility of light-shielding material or the like, and suitable polypropylene resins have a melt flow rate (ASTM D-1238, at 230° C. at 2.16 kg) of 10 to 80 g/10 minutes, preferably 15 to 50 g/10 minutes, a bending elastic modulus (ASTM D-790) of not less than 4,000 kg/cm$^2$, preferably not less than 8,000 kg/cm$^2$, and a notched Izod impact strength (ASTM D-256, at 23° C.) of not less than 2.0 kg.cm/cm.

As a characteristic of the invention, since buckling and bottom sink mark do not occur by roughening the inner surface of the pheripheral wall portion of the container body, the bending elastic modulus can be decreased to less than one half that of conventional container body, i.e. 4,000 kg/cm$^2$ or more. As a result, sealability and fitting of containers in body-cap joined type are improved.

As properties of various polyethylene resins (homopolymer, random copolymer or block copolymer), suitable polyethylene resins having a melt flow rate (ASTM D-1238, at 190° C. at 2.16 kg) of 5 to 80 g/10 minutes, preferably 7 to 70 g/10 minutes, more preferably 10 to 60 g/10 minutes, particularly preferably 11 to 40 g/10 minutes, a density (ASTM D-1505) of not less than 0.935 g/cm$^3$, preferably not less than 0.940 g/cm$^3$, more preferably not less than 0.950 g/cm$^3$, particularly preferably not less than 0.960 g/cm$^3$, and a bending rigidity (ASTM D-747) or not less than 4,000 kg/cm$^2$, preferably not less than 6,000 kg/cm$^2$, more preferably not less than 8,000 kg/cm$^2$, particularly preferably not less than 10,000 kg/cm$^2$. When physical strength or transparency is required, preferable resins are homopolyethylene resins and ethylene-α-olefin random copolymer resin containing 0.01 to 2 wt. % of nucleating agent. When coloring or light-shielding is required, preferable resins are homopolyethylene resins and ethylene-α-olefin block copolymer resins containing coloring pigment or light-shielding material.

Suitable ethylene copolymer resins are ethylene-vinyl acetate copolymer (EVA) resin, ethylene-propylene copolymer resin, ethylene-1-butene copolymer resin, ethylene-butadiene copolymer resin, ethylene-vinyl chloride copolymer resin, ethylene-methylmethacrylate copolymer resin, ethylene-methyl acrylate copolymer (EMA) resin, ethylene-ethyl acrylate copolymer (EEA) resin, ethylene-acrylonitrile copolymer resin, ethylene-acrylic acid copolymer (EAA) resin, ionomer resin (copolymer of ethylene and unsaturated acid cross-linked using metal such as zinc), ethylene-α-olefin copolymer (L-LDPE) resin, ethylene-propylene-butene-1 ternary copolymer resin, polyolefin resin elastomer, and the like. Among the above ethylene copolymer resins, L-LDPE resin and EEA resin are preferred, because they do not affect adversely photographic photosensitive materials, and have a great effect on the improvement in physical strength, excellent dispersibility of light-shielding material and a great strength of weld line.

Besides, it is also preferable to blend the other thermoplastic resins, various elastomers, such as synthetic rubber, various additives, modifiers, etc.

Among the ethylene copolymer resins, particularly preferred is ethylene-α-olefin copolymer resin which is called, in general, linear low density polyethylene (L-LDPE) resin.

The L-LDPE resin is called third polyethylene resin, and it is a low cost high strength resin, having the advantages of both low, medium density polyethylene resin and high density polyethylene resin, which meets the requirements, i.e. resource conservation and energy conservation, of the times. The L-LDPE resin is a copolymer of ethylene and α-olefin, and it has a linear structure having short branched. The ethylene content is 85 to 99.5 mol. %, and the number of carbon atoms of the α-olefin is 3 to 13. Preferable α-olefin has a number of carbon atoms of 4 to 10, and examples of the α-olefin are butene-1, 4-methylpentene-1, hexene-1, heptene-1 and octene-1. The density is usually in the degree of low medium polyethylene resin, but in the container for a photographic film of the invention, a suitable L-LDPE resin is selected from those having a density in the range of 0.90 to 0.97 g/cm$^2$ and a melt flow rate (ASTM D-1238) in the range of 5 to 80 g/10 minutes according to the object of use. In view of protecting the photographic film cartridge and ensuring sealability, in the case of cap separated from body type (FIG. 1, FIG. 2 etc.), a preferable Olsen rigidity (ASTM D-747) of a container body is not less than 5,000 g/cm$^2$ and that of a cap is not more than 4,500 g/cm$^2$. In the case of body-cap joined type (FIG. 3, FIG. 4, FIG. 7, FIG. 8, etc.), a preferable Olsen rigidity is 5,000 to 18,000 kg/cm$^2$.

As the polymerization process of L-LDPE resin, there are the vapor process and the liquid slurry process using a medium, low pressure apparatus and the ion polymerization process using an apparatus for the high pressure modified method.

Examples of commercial L-LDPE resin (with the trademark names of said examples appearing in quotation marks and the respective names of the manufacturers following thereafter in parentheses, as is the case hereinafter) are "G-Resin" and "TUFLIN" (UCC), "NUC Polyethylene-LL" and "TUFTHENE" (Nippon Unicar), "Idemitsu Polyethylene-L" and Moretec (Idemitsu Petrochemical), "Dowlex" (Dow chemical), "Suclear" (Dupont de Nemour, Canada), "Marlex" (Phillips), "Neozex" and "Ultzex" (Mitsui Petrochemical Industries), "Nisseki Linirex" (Nippon Petrochemicals), "Stamilex" (DMS) "MItsubishi Polyethy-LL" (Mitsubishi Petrochemical), and the like.

Very low density L-LDPE resins having a density of less than 0.910 g/cm$^3$ are also preferable, such as "NUC-FLX" (UCC) and "Excelene VL" (Sumitomo Chemical).

Adhesive polyolefin resins are also preferable because of improving the dispersibility of light-shielding material and the like and various properties. The adhesive polyolefin resin is a modified resin of polyolefin resin graft-modified with unsaturated carboxylic acid compound, and includes graft-modified polyethylene resin, graft-modified ethylene-ethyl acrylate copolymer resin, graft-modified ethylene-vinyl acetate copolymer resin, graft-modified polypropylene resin, graft-modified poly-α-olefin resins, such as polybutene-1 resin and poly-4-methylpentene-1 resin, and ethylene-α-olefin copolymer resins graft-modified with unsaturated carboxylic acid compound. Graft-modified polyolefin resins grafted with an unsaturated carboxylic acid compound, such as acrylic acid, maleic acid or maleic anhydride, are preferred. A suitable grafting rate of the unsaturated carboxylic acid compound is 0.01 to 10%.

The unsaturated carboxylic acid compound usable as the modifier of the polyolefin resin is acrylic acid, methacrylic acid, crotonic acid, isocrotonic acid, fumaric acid, maleic acid, itaconic acid, citraconic acid, angelic acid, tetrahydrophthalic acid, sorbic acid, mesaconic acid, nudic acid (end-cis-bicyclo[2,2,1]-hepto-5-en-2,3-dicarboxylic acid), maleic anhydride, itaconic anhydride, citraconic anhydride, aconitic anhydride, methyl acrylate, methyl methacrylate, ethyl methacrylate, ethyl acrylate, n-butyl acrylate, glycidyl acrylate, glycidyl methacrylate, glycidyl maleate n-butyl methacrylate, maleic acid monoethyl ester, maleic acid diethyl ester, fumaric acid monomethyl ester, fumaric acid dimethyl ester, itaconic acid diethyl ester, acrylamide, methacrylamide, maleic acid monoamide, maleic acid diamide, maleic acid-N-monoethylamide, maleic acid-N,N-diethylamide, maleic acid-N-monobutylamide, maleic acid-N,N-dibutylamide, fumaric acid monoamide, fumaric acid diamide, fumaric acid-N-monoethylamide, fumaric acid-N,N-diethylamide, fumaric acid-N-monobutylamide, fumaric acid-N,N-dibutylamide malemide, N-butylmaleimide, N-phenylmaleimide, malonlyl chloride, mnomethylmaleate, dimethylmaleate, dipropylmaleate, potassium acrylate, sodium acrylate, zinc acrylate, magnesium acrylate, calcium acrylate, sodium methacrylate, potassium methacrylate, or the like. Two or more unsaturated carboxylic acid compounds may be combined. Preferable unsaturated carboxylic acid compounds are acrylic acid, maleic acid, maleic anhydride and nudic acid, and maleic anhydride is particularly preferred. A suitable amount of the unsaturated carboxylic acid compound is 0.01 to 20 parts by weight, preferably 0.2 to 5 parts by weight, per 100 parts by weight of the polyolefin base resin in view of securing adhesive strength.

The grafting modification method may be any known method, such as the method of reacting in a melted state disclosed in Japanese Patent KOKOKU No. 43-27421, the method of reacting in a solution state disclosed in Japanese Patent KOKOKU No. 44-15422, the method of reacting in a slurry state disclosed in Japanese Patent KOKOKU No. 43-18144 and the method of reacting in a vapor state disclosed in Japanese Patent KOKOKU No. 50-77493. Among them, the melting method using an extruder is preferred because of simple operation and inexpensiveness.

A peroxide is added in order to accelerate the reaction between the polyolefin base resin and the unsaturated carboxylic acid, Suitable peroxides are organic peroxides such as benzoyl peroxide, lauroyl peroxide, dicumyl peroxide, α,α'-bis(t-butylperoxydiisopropyl)-benzene, 2,5-dimethyl-2,5-di(t-butylperoxy)hexane, 2,5-dimethyl-2,5-di(t-butylperoxy)hexyne, di-t-butyl peroxide, cumene hydroperoxide, t-butyl-hydroperoxide, t-butylperoxylaurate, t-butylperoxybenzoate, 1,3-bis(t-butylperoxyisopropyl) benzene, di-t-butyl-diperoxyphthalate, t-butylperoxymaleic acid and isopropyl percarbonate, azo compounds such as azobisisobutyronitrile, and inorganic peroxides such as ammonium persulfate. Two or more peroxides may be combined. Particularly preferred peroxides are di-t-butylperoxide, dicumylperoxide, 2,5-dimethyl-2,5-di(t-butylperoxy)hexane, 2,5-dimethyl-2,5-di(t-butylperoxy) hexyne, 1,3-bis(t-butylperoxyisopropyl)benzene and the like, which have a decomposition temperature between 170° C. and 200° C. A suitable amount of the peroxide is 0.005 to 5 parts by weight, preferably 0.01 to 1 part by weight per 100 parts by weight of the polyolefin base resin.

There are commercial adhesive polyolefin resins, such as "N polymer" (Nippon Petrochemicals), "Admer" (Mitsui Petrochemical Industries), "ER Resin" (Showa Denko), "Novatec-AP" (Mitsubishi Chemical Industries), "Modic" (Mitsubishi Petrochemical), "NUC-Ace" (Nippon Unicar), "Ube Bond" (Ube Ind.), "Bondain" (Sumitomo Chemical), "Melcene M" (Toso), "CMPS" (Mitsui Polychemicals), etc.

Taking into consideration the case of reclamation treatment as waste, degradable plastic which is being developed or has already introduced in the market can be used for the container for a photographic film of the invention. For example, a biodegradable polymer of "BIOPOL" (ICI), "Polycaprolactone" (UCC) or the like is utilized, or a polymer indirectly collapsed by blending a biodegradable natural or synthetic polymer as an additive, such as polyethylene blended with starch, can be utilized.

Moreover, it is also possible to utilize a photodegradable polymer, such as ECO copolymer wherein carbonyl groups are introduced into the main chain as a photosensitization group at the time of polymerization of ethylene, i.e. copolymerization of ethylene and carbon monoxide, polymers to which photodegradability is imparted by adding transition metal salt, oxidation accelerator, photosensitizer or the like to base polymer (see Japanese Patent KOKAI No. 3-129341).

A lubricating material may be added to the container for a photographic film of the invention in order to decrease the bursting sound, to shorten the molding cycle, to decrease molding troubles, such as abrasion, bottom sink mark, and buckling, to improve insertion of photographic film, wear resistance, slipping character, and the like. As the lubricating material, lubricant, antistatic agent, surfactant, dripproofing substance, and the like can be used.

Suitable lubricants, which do not affect photographic film adversely, are described below.

Silicone Lubricants dimethylpolysiloxanes and modified thereof in various grades, carboxyl-modified silicone, α-methylsyrene-modified silicone, α-olefin-modified silicone, polyester-modified silicone, epoxy-modified silicone, amide-modified silicone, amino-modified silicone, alcohol-modified silicon (Shin-Etsu Silicone, Toray Silicone), etc.

Oleic Acid Amide Lubricants

"ARMOSLIP-CP" (Lion Akzo Co., Ltd.), "NEWTRON" and "NEWTRON-E18" (Nippon Fine Chemical Co., Ltd.), "AMIDE-O" (Nitto Kagaku K.K.), "DIAMID O-200" and "DIAMID G-200" (Nippon Kasei Chemical Co., Ltd.), "ALFLOW E-10" (Nippon Oil and Fats Co., Ltd.), etc.

Erucic Acid Amide Lubricants

"ALFLOW P-10" (Nippon Oil and Fats Co., Ltd.), etc.

Stearic Acid Amide Lubricants

"ALFLOW S-10" (Nippon Oil and Fats Co., Ltd.), "NEWTRON 2" (Nippon Fine Chemical Co., Ltd.), "DIAMID 200" (Nippon Kasei Chemical Co., Ltd.), etc.

Bis Fatty Acid Amide Lubricants

"BISAMIDE" (Nitto Kagaku K.K.), "DIAMID-200 BIS" (Nippon Kasei Chemical Co., Ltd.), "ARMOWAX-EBS" (Lion Akzo Co., Ltd.), etc.

Alkylamine Lubricants

"ELECTROSTRIPPER TS-2" (Kao Corp.), etc.

Hydrocarbon Lubricants liquid paraffin, natural paraffin, microwax, synthetic paraffin, polyethylene wax, polypropylene wax, chlorinated hydrocarbon, fluorocarbon, etc.

Fatty Acid Lubricants higher fatty acids preferably more than $C_{12}$, hydroxy fatty acids, etc.

Ester Lubricants fatty acid lower alcohol esters, fatty acid polyol esters, fatty acid polyglycol esters, fatty acid fatty alcohol esters, etc.

Alcohol Lubricants polyols, polyglycols, polyglycerols, etc.

Metallic Soap metal salts such as Li, Na, K, Mg, Ca, Sr, Ba, Zn, Cd, Al, Sn, Pb salts of higher fatty acids such as lauric acid, stearic acid, succinic acid, stearyl lactic acid, benzoic acid, hydroxystearic acid, lactic acid, phthalic acid, ricinoleic acid, naphthenic acid, oleic acid, etc.

FIG. 25 shows a relationship between some lubricants varying the kind and the blending amount and statical friction coefficient of a container body for a photographic film. The resin used was propylene-ethylene copolymer resin having a MFR of 40 g/10 minutes, and in the figure, a indicates the resin blended with 0.5 wt. % of oleic amide, b indicates the resin blended with 0.3 wt. % of oleic amide, c indicates the resin blended with 0.3 wt. % of erucic amide, d indicates the resin blended with 0.3 wt. % of stearic amide, e indicates the resin blended with 1.0 wt. % of alkylamine lubricant ("Electrostripper TS-2", Kao), f indicates the resin blended with 0.1 wt. % of oleic amide, and g indicates the resin blended with no lubricant.

FIG. 26 shows a relationship between lubricant and moldability. The figure indicates a relationship between the blending amount of oleic amide and molding cycle, when a cap of a photographic film container was molded using LDPE resin blended with oleic amide. The mold was a 24-cavity mold in a hot runner type, and the molding machine used was an injection molding machine with a toggle type clamping mechanism at a mold clamping pressure of 150 t.

Antistatic agent applicable to the invention includes:

Nonionic Antistatic Agent

Alkylamine Derivatives

Polyoxyethylene alkyl amines, tertiary amine e.g. laurylamine, N,N-bis(2-hydroxyethyl cocoamine, N-hydroxyhexadecyl-di-ethanolamine, N-hydroxyoctadecyl-di-ethanolamine, etc.

Fatty Amide Derivatives

Oxalic acid-N,N'-distearylamide bytyl ester, polyoxyethylene alkyl amide, etc.

Ethers

Polyoxyethylene alkyl ether, polyoxyethylene alkyl phenyl ether, etc.

Polyol Esters

Glycerine fatty acid esters, sorbitan fatty acid esters, 1-hydroxyethyl-2-dodecylglyoxazoline, etc.

Anionic Antistatic Agent

Sulfonates

Alkyl fulfonate ($RSO_3Na$), alkylbenzene sulfonate, alkyl sulfate ($ROSO_3Na$), etc.

Phosphate Esters

Alkyl phosphate, etc.

Cationic Antistatic Agent

Cationic Amides

Quaternary Ammonium Salts

Quaternary ammonium chloride, quaternary ammonium ammonium sulfate, quaternary ammonium nitrate, e.g. stearamide propyl-dimethyl-β-hydroxyethyl ammonium nitrate, etc.

Ampholytic Antistatic Agent

Alkyl Betaines

Imidaxolines

Alkyl Imidazolines

Metal Salts $(RNR'CH_2CH_2CH_2NCH_2COO)_2Mg$ ($R \geqq C$, R'—H or $(CH_2)_mCOO$—, etc.

Alkyl Alanines

Conductive Resin

Polyvinylbenzyl cation, polyacrylic acid cation, etc.

Among them, nonionic antistatic agents are particularly preferred, because adverse affect upon photographic properties and human body is small.

As the internal antistatic agent for the inside, and of nonionic antistatic agent, anionic antistatic agent or ampholytic antistatic agent can be used. Effective nonionic antistatic agents are ethylene oxide adducts of higher alcohol, ethylene oxide adducts of alkyl phenol, esters, such as esters of higher fatty acid and polyol, polyethylene glycol esters of higher fatty acid, polyethers, amides, such as higher fatty amides, dialkyl amides and ethylene oxide adducts of higher fatty amide. Effective anionic antistatic agents are alkyl allylphosphonic acids, adipic acid, glutamic acid, alkyl sulfonic acid salts, alkyl sulfates, polyoxyethylene alkylphosphates, fatty acid salts, alkyl banzene sulfonates, alkyl naphthalene sulfonates, and sodium dialkyl sulfosuccinates. As to cationic antistatic agent, amines, such as alkyl amine phosphates, Schiff's base, amide amines, polyethylene imines, complexes of amide amine and metal salt and alkyl esters of amino acid, imidazolines, amine-ethyleneoxide adducts and quaternary ammonium salts are suitable. As to ampholytic antistatic agent, N-acylsarcosinate, amino carboxylic acid esters, alanine metal salts, imidazoline metal salts, carboxylic acid metal salts, dicarboxylic acid metal salts, diamine metal salts, metal salts having ethylene oxide groups, and the like are suitable. As to the other antistatic materials, inorganic electrolytes, metal powders, metal oxides, kaolin, silicates, carbon powder and carbon fiber also exercise the effect of the invention. Besides, graft polymers and polymer blends are also effective.

As to the external antistatic agent for the outside, nonionic antistatic agent includes polyols, such as glycerine, sorbit, polyethylene glycol and polyethylene oxide, polyol esters, higher alcohol-ethylene oxide adducts, alkylphenol-ethylene oxide adducts, fatty acid-ethylene oxide adducts, amides, amide-ethylene oxide adducts and amine-ethylene oxide adducts. Ampholytic antistatic agent includes carboxylic acids, such as alkylalanines, and sulfonic acids. As anionic antistatic agent, carboxylic acid salts, sulfuric acid derivatives, such as alkyl sulfonates, phosphoric acid derivatives, such as phosphonic acid, phosphate esters, and polyester derivatives are suitable. As cationic antistatic agent, amines, such as alkylamines, amido amines and ester amines, vinyl nitrogen derivatives, quaternary ammonium salts, such as ammonium salts containing amide group and ammonium salts containing ethylene oxide, acrylic acid ester derivatives, acrylic amide derivatives, vinyl ether derivatives, and the like are suitable.

Examples of the surfactant are shown below.

Nonionic Surfactants (Representative Component: Polyethylene Glycol Compound)

Polyethyleneglycol fatty acid ester, polyoxyethylene sorbitan fatty acid ester, polyoxyethylene fatty alcohol ester, polyoxyethylene glycerine fatty acid ester, polyoxyethylene fatty amine, sorbitan monofatty acid ester, fatty acid pentaerythritol, fatty alcohol-ethylene oxide adduct, fatty acid-ethylene oxide adduct, fatty amino acid or fatty amide-ethylene oxide adduct, alkyl phenol-ethylene oxide adduct, alkyl naphthol-ethylene oxide adduct, partial fatty ester of polyol-ethylene oxide adduct, various other nonionic antioxidants disclosed in Japanese Patent KOKOKU No. 63-26697, etc.

Anionic Surfactants (Representative Component: Polyoxyethylene Glycol Compound)

Sodium salt of ricinoleic acid sulfate ester, various fatty acid metal salts, sodium salt of ricinoleate ester sulfate ester, sulfated oleic acid ethylaniline, sulfate ester salt of olefin, sodium salt of oleil alcohol sulfate ester, alkyl sulfate ester salt, fatty acid ethyl sulfonic acid salt, alkyl sulfonic acid salt, alkyl naphthalene sulfonic acid salt, alkyl benzene sulfonic acid salt, succinic acid ester sulfonic acid salt, phosphate ester salt, etc.

Cationic Surfactants (Representative Component: Quaternary Ammonium Salt)

Primary amine salts, tertiary amine salts, quaternary ammonium slats, pyridine derivatives, Amphoretic Surfactants Carboxylic acid derivatives, imidazoline derivatives, betaine derivatives.

A suitable blending amount of the antistatic agent is 0.001 to 5 wt. %, and 0.005 to 3 wt. % is preferred. When the blending amount is less than 0.001 wt. %, the antistatic action and lubricating action are insufficient. When the blending amount exceeds 5 wt. %, not only the effect increased by increasing the blending amount is little but also various troubles occur, such as bleeding out with time, variation of injected resin amount due to screw slip resulting in the occurrence of molding troubles, such as short shot and burns.

As the dripproofing substance, there are water-absorptive or hygroscopic substance and dripproofing agent.

The dripproofing agent includes any substance which renders a contact angle of pure water of less than 50 degrees, preferably less than 45 degrees, particularly preferably less than 35 degrees, with the photographic film container containing 0.01 to 3 wt. % of the substance.

The dripproofing agent includes diglycerine monostearate ester, polyglycerine monopalmitate ester, sorbitan monolaurate ester, sorbitan monoerucate, polyoxyethylene sorbitan fatty acid ester, stearic acid monoglyceride, palmitate monoglyceride, oleate monoglyceride, laurate monoglyceride, polyoxyethylene nonylphenyl ether, sorbitan sesquipalmitate, diglycerine sesquioleate, sorbitol fatty acid ester, sorbitol fatty acid dibasic acid ester, diglycerine fatty acid dibasic acid ester, glycerine fatty acid dibasic acid ester, sorbitan fatty acid dibasic acid ester, sorbitan palmitate, sorbitan stearate, sorbitan palmitate propylene oxide 3 moles adduct, sorbitan palmitate propylene oxide 2 moles adduct, sorbitol stearate, sorbitol stearate ethylene oxide 3 moles adduct, diglycerine palmitate, glycerine palmitate, glycerine palmitate ethylene oxide 2 moles adduct, etc.

The water-absorptive or hygroscopic substance is a hydrophilic polymer or water-absorptive polymer having a hydrophilic group which is a polar group or ionic group, e.g. hydroxyl group, carbonyl group, carboxyl group, amino group, amide group, imide group and sulfonyl group, connected to polymer chain or side chain. Examples of the water-absorptive or hygroscopic substances are polyvinyl alcohol, starch, surface-treated starch, modified starch, starch-acrylonitrile hydrolyzate, oxide of vinyl acetate-methyl acrylate copolymer, crosslinked polyacrylamide, polyacrylamide-acrylic acid copolymer, polyacrylic acid-diacrylate copolymer, polyethylene oxide, polyvinyl pyrrolidone, crosslinked polyvinyl alcohol, polyethylene glycol, etc.

The dripproofing agent, the water-absorptive substance and the hygroscopic substance may be combined.

It is preferable to provide the container for a photographic film containing the dripproofing substance with a surface activation treatment, such as corona discharge, ozone treatment or plasma treatment because of exhibiting dripproof action and antifog action more effectively.

A suitable blending amount of the lubricating material is 0.001 to 5 wt. %, preferably 0.01 to 3 wt. %, particularly preferably 0.02 to 2 wt. %. When the blending amount is less than 0.001 wt. %, the occurrence of buckling and bottom sink mark can not be prevented. Bursting sound generates at the time of extracting the core from the container body, and it is difficult to shorten molding cycle. The blending effects do not exhibit. When the blending amount exceeds 5 wt. %, bleeding out increases. The effect increased by increasing the blending amount is little.

To the container for a photographic film of the invention, light-shielding material may be added in order to improve printability, rigidity, light-shielding ability (opacity), physical strength, particularly dropping impact strength or the like.

Representative examples of the light-shielding material is shown below.

Inorganic Compounds

Oxides . . . Silica, diatomaceous earth, alumina, titanium oxide, iron oxide, zinc oxide, magnesium oxide, antimony oxide, barium ferrite, strontium ferrite, berylium oxide, pumice, pumice balloon, alumina fiber, etc.

Hydroxides . . . aluminum hydroxides, magnesium hydroxides, basic magnesium carbonate, etc.

Carbonates . . . calcium carbonate, magnesium carbonate, dolomite, dawsonite, etc.

Sulfates, sulfites . . . calcium sulfate, barium sulfate, ammonium sulfate, calcium culfite, etc.

Silicates . . . talc, clay, mica, asbestos, glass fiber, glass baloon, glass bead, calcium silicate, montomorillonite, bentonite, zeolite, etc.

Carbons . . . carbon black, graphite, carbon fiber, carbon hollow bead, etc.

Others . . . iron powder, copper powder, lead powder, tin powder, stainless steel powder, pearl pigment, aluminum powder, molybdenum sulfide, boron fiber, silicon carbide fiber, brass fiber, potassium titanate, lead titanate zirconate, zinc borate, barium metaborate, calcium borate, sodium borate, aluminum paste, etc.

Organic Compounds wood flour such as pine, oak and sawdust, husk fiber such as almond, peanut and chaff, colored various fibers such as cotton, jute, paper piece, cellophane piece, nylon fiber, polypropylene fiber, various starch (containing modified starch, surface-treated starch, etc.), aromatic polyamide fiber, etc.

Among them, inorganic compounds rendering opaque are preferable, and carbon black, titanium nitride and graphite which are light-absorptive light-shielding material are particularly preferred, since they are excellent in light-shielding ability, heat resistance and light resistance and are relatively inactive materials.

Carbon blacks are divided into gas black, oil furnace black, channel black, anthracene black, acetylene black, Ketchen carbon black, thermal black, lamp black, vegetable black and animal black according to their origin. Among these, oil furnace carbon black is preferable in terms of photographic properties, light-shielding character, cost and improvement of properties. On the other hand, since acetylene black and Ketschen carbon black which is modified by-produced carbon black have an antistatic character, they are also preferable, though they are expensive. They may be blended with the oil furnace black in order to improve its character. As the representative blending methods of carbon black, there are dry coloring, paste color, wet coloring, masterbatch pellets, powder dye, pigment coloring, compound color pellets and the like.

The masterbatch method using masterbatch pellets is preferred in view of cost and less contamination of the working place. Japanese Patent KOKOKU No. 40-26196 discloses a method of making a masterbatch of polymer-carbon black by dissolving the polymer in an organic solvent and dispersing the carbon black into the solution. Japanese Patent KOKOKU NO. 43-10362 discloses another method of making a masterbatch by dispersing the carbon black into polyethylene. The inventor also disclosed a resin composition for color masterbatch (EP 0,277,598A).

As the preferable light-shielding materials, inorganic pigments having a refraction index measured by the Larsen oil immersion test of more than 1.50, various metal powders, metal flakes, metal pastes, metal fibers, and carbon fiber are next to carbon black. Representative examples are titanium oxide in rutile type (2.76), titanium oxide in anatase type (2.52), zinc oxide (2.37), antimony oxide (2.35), lead white (2.09), zinc white (2.02), lithopone (1.84), baryta powder (1.64), barium sulfate (1.64), calcium carbonate (1.58), talc (1.58), calcium sulfate (1.56), silicic anhydride (1.55), silica powder (1.54), magnesium hydroxide (1.54), basic magnesium carbonate (1.52), alumina (1.50), and the like. Particularly preferable light-shielding materials have a refraction index of not less than 1.56, more preferably not less than 1.60. The number in parenthesis indicates refraction index. On the other hand, since calcium silicate (1.46), diatomaseous earth (1.45), hydrous silicate (1.44) and the like have a refraction index of less than 1.50, they are unsuitable. As the representative examples of metal powder, including metal paste, there are copper powder, stainless steel powder, iron powder, silver powder, tin powder, zinc powder, steel powder, etc.

A suitable blending amount of the light-shielding material is 0.01 to 40 wt. %, preferably 0.05 to 30 wt. % particularly preferably 0.1 to 20 wt. %. When the blending amount is less than 0.01 wt. %, the blending effect does not exhibit. On the other hand, when the blending amount exceeds 40 wt. %, physical strength, particularly dropping impact strength, greatly decreases, weld line strongly occurs and appearance is degraded.

It is preferable that the surface of light-shielding material is coated in order to improve dispersibility of the light-shielding material, to prevent the occurrence of lumps and to prevent the fouling of the mold surface.

Suitable materials for coating the surface of light-shielding material are those capable of coating easily and preventing aggregation of the light-shielding material, and include various waxes, acid-modified thermoplastic resins including the aforementioned adhesive polyolefin resins. Acid-modified polyolefin resins, ethylene-acrylate ester copolymer resin and ethylene-vinyl acetate copolymer resin are preferable. Among the acid-modified polyolefin resins, particularly preferred ones have a low Vicat softening point, preferably not more than 100° C., particularly preferably not more than 90° C., and a melt flow rate of not less than 1 g/10 minutes, preferably not less than 5 g/10 minutes, particularly preferably not less than 8 g/10 minutes. Low molecular weight polyolefin resins are also preferable, and it is preferable to use polyethylene wax (homopolyethylene wax, ethylene-α-olefin wax) or polypropylene wax as a single material or a blend with a thermoplastic resin in the following material. Various lubricants, surfactants and antistatic agents are mentioned previously, plasticizers coupling agents, etc. are also preferable because of improving the dispersibility of light-shielding material, moldability, surface smoothness, slipping character, antistatic properties, preventing the occurrence of lumps, and improving packaging processibility of photographic film, and capable of blending lubricant, surfactant, antistatic agent and plasticizer which tend to bleed out in a state adsorbed on or reacting with the light-shielding material.

Particularly suitable materials for coating the surface of light-shielding material include divalent to quadrivalent alcohols having a number of carbon atoms of 2 to 18, preferably 2 to 6. Examples of dihydric alcohol are ethylene glycol, propylene glycol, pentamethylene glycol, heptamethylene glycol, dodecamethylene glycol, 1,3-dihydroxybutane, 1,4-dihydroxybutane, 2,5-dihydroxyhexane and 2,4-dihydroxy-2-methylpentene, and examples of trihydric alcohol are trimethylolethane, trimethylolpropane and glyceine. An example of tetrahydric alcohol is pentaerithritol. Preferable polyoles have a number of carbon atoms of 4 to 5 and three methylol group and have four methylol groups, and trimethylolethane and pentaerithritol are particularly preferred. A suitable coating amount of polyol is 0.001 to 20 wt. %, preferably 0.005 to 10 wt. %, particularly preferably 0.01 to 5 wt. %, of light-sensitive material. To combine polyol with lubricant is preferable because of improving various properties simultaneously, such as moldability, slipping character, prevention of the generation of white powder, packaging processibility and the like.

The polyol can be coated on the surface of the light-shielding material by the method of immersing the light-shielding material is polyol dissolved in a solvent and then evaporating the solvent to dryness, by the method of spraying polyol dissolved in a solvent to the light-shielding material and then removing the solvent to dryness, by the method of melting polyol and kneading with the light-shielding material or the like. A particularly preferable method is of kneading the light-shielding material with polyol and then grinding. As a mean therefor, polyol is added at the time of grinding the light-shielding material by a fluid energy pulverizer, such as a micronizer or a jet mill, to coat the surface of the light-shielding material by using a high shearing force blender, such as Henschel mixer or super mixer, to coat the surface of the light-shielding material, or the like.

It is preferable to coat the surface of the light-shielding material with ethylene copolymer resin, acid-modified resin, maleic anhydride copolymer resin, low Vicat softening point resin of not more than 100° C., paraffin wax, polyethylene wax, polypropylene wax or the like by kneading with temperature and high shearing force.

Various lubricants, various surfactants, various antistatic agents, various dripproofing agents can be coated on the surface of the light-shielding material by the method similar to the above polyol.

Antioxidant may be blended into the container for a photographic film of the invention in order to prevent the generation of the materials which adversely affect photographic properties of photographic film by thermal decomposition and to prevent resin yellowing. When lumps generate by resin yellowing, they induce gate clogging resulting in the occurrence of molding troubles, such as short short, and occasionally the occurrence of no shot.

Examples of the antioxidant are as follows:

Phenol Antioxidants 6-t-butyl-3-methylphenol derivatives, 2,6-di-t-butyl-p-cresol-t-butylphenol, 2,2'-methylenebis-(4-ethyl-6-t-butylphenol), 4,4'-butylidenebis(6-t-butyl-m-cresol), 4,4'-thiobis(6-t-butyl-m-cresol), 4,4-dihydroxydiphenylcyclohexane, alkyl group-induced bisphenol, styrene group-induced phenol, 2,6-di-t-butyl-4-methylphenol, n-octadecyl-3-(3',5'-di-t-butyl-4'-hydroxyphenol)propionate, 2,2'-methylenebis(4-methyl-6-t-butylphenol), 4,4'-butylidenebis(3-methyl-6-t-butylphenol), stearyl-β-(3,5-di-4-butyl-4-hydroxyphenyl)propionate, 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis [methylene-3-(3',5'-di-t-butyl-4'-hydroxyphenyl) propionate]methane, etc.

Ketone-Amine Condense Antioxidants 6-ethoxy-2,2,4-trimethyl-1,2-dihydroquinoline, polymers of 2,2,4-trimethyl-1,2-dihydroquinoline, trimethyldihydroquinoline derivatives, etc.

Arylamine Antioxidants

Phenyl-α-naphthylamine, N-phenyl-β-naphthylamine, N-phenyl-N'-isopropyl-p-phenylenediamine, N,N'-diphenyl-p-phenylenediamine, N,N'-di-β-naphthyl-p-phenylenediamine, N-(3'-hydroxybutylidene)-1-naphtylamine, etc.

Imidazole Antioxidants 2-mercaptobenzoimidazole, zinc salt of 2-mercaptobenzoimidazole, 2-mercaptomethylbenzoimidazole, etc.

Phosphite Antioxidants

Alkyl-induced arylphosphite, diphenylisodecylphosphite, sodium phosphite salt of tris(nonylphenyl)phosphite, trinonylphenylphosphite, triphenylphosphite, etc.

Thiourea Antioxidants

Thiourea derivatives, 1,3-bis(dimethylaminopropyl)-2-thiourea, etc.

Other Antioxidants

Those useful for air oxidation, such as dilauryl thiodipropionate, metal deactivators, etc.

Preferable antioxidants are phenol antioxidants, and particularly effective antioxidants are BHT, low volatile high molecular weight phenol antioxidants ("Irganox 1010", "Irganox 1076", trade names of Ciba-Geigy A.G., "Topanol CA", trade name of I.C.I., etc.) dilaurylthiodipropionate, distearylthiodipropionate, dialkylphosphate, etc. Two or more antioxidants may be combined.

Particularly preferable antioxidants are hindered phenolic antioxidants because of rare adverse affect upon photographic properties of photographic photosensitive materials. The hindered phenolic antioxidants are 1,3,5-trimethyl-2,4,6-tris(3,5-di-tert-butyl-4-hydroxybenzyl) benzene, tetrakis methylene(3,5-di-tert-butyl-4-hydroxy-hydrocinnamate methane, octadecyl-3,5-di-tert-butyl-4-hydroxy-hydrocinnamate, 2,2',2'-tris (3,5-di-tert-butyl-4-hydroxyphenyl)propionyloxy ethylisocyanulate, 1,3,5-tris(4-tert-butyl-3-hydroxy-2,6-di-methylbenzyl) isocyanulate, tetrakis(2,4-di-tert-butylphenyl)-4,4'-biphenylene diphosphite ester, 4,4'-triobis-(6-tert-butyl-o-cresol), 2,2'-thiobis-(6-tert-butyl-4-methylphenol), tris-(2-methyl-4-hydroxy-5-tert-butylphenyl)butane, 2,2'-methylene-bis-(4-methyl-6-tert-butylphenol), 4,4'-methylene-bis-(2,6-di-tert-butylphenol), 4,4'-butylidenebis-(3-methyl-6-tert-butylphenol), 2,6-di-tert-butyl-4-methylphenol, 4-hydroxymethyl-2,6-di-tert-butylphenol, 2,6-di-tert-4-n-butylphenol, 2,6-bis(2'-hydroxy-3'-tert-butyl-5'-methylbenzyl)-4-methylphenol, 4,4'-methylene-bis-(6-tert-butyl-o-cresol), 4,4'-butylidene-bis-(6-tert-butyl-m-cresol) and the like. According to the properties of antioxidants, two or more kinds of antioxidants may be combined. Preferable antioxidants have a melting point of more than 100° C., particularly preferably more than 120° C.

A suitable content of the antioxidant is 0.001 to 1 wt. %, preferably 0.005 to 0.5 wt. %, particularly preferably 0.07 to 0.3 wt. %. When the content is less than 0.001 wt. %, the blending effect is small. Degradation of photographic properties, such as fogging and sensitivity deviation, occurs by the thermal decomposition of resin, lumps increase by resin yellowing, and coloring trouble increases. While, when the content is beyond 1 wt. %, photosensitive materials are adversely influenced by antioxidant, resulting in the occurrence of fogging or sensitivity derivation. When antioxidant is combined with carbon black, oxidation inhibition and prevention of coloring synergistically appears. The oxidation inhibition effect is particularly exercised by combining a phenolic antioxidant (hindered phenolic antioxidant is preferred.), a phosphorous-containing antioxidant and carbon black. Vitamine E is particularly preferable for colored containers because of improving coloring and oxidation inhibition.

Besides, other antioxidants usable in the invention can be selected from those disclosed in "Plastic Data Handbook" (published by Kogyo Chosa Kai), pages 794–799, "Plastic Additives Data Collection" (published by Kagaku Kogyo), pages327–329, "Plastic Age Encyclopedia, Advance Edition 1986" (published by Plastic Age), pages 211–212, etc.

The mechanism of the antioxidant so as not to affect photographic photosensitive materials is considered as follows:

Oxidative degradation tends to occur in polyolefin resin having more $CH_3$ branches due to a greater oxygen absorption. Accordingly, oxidative degradation occurs in the order to more: polypropylene resin > homopolyethylene resin > ethylene-α-olefin copolymer resin: less.

Various polyethylene resins containing ethylene-α-olefin copolymer resins and various polypropylene resins being representative crystalline thermoplastic resins are hydrocarbons, and it is considered that when a radical group is produced through dehydration of hydrocarbon in the presence of oxygen, antioxidation proceeds in the following formulas as chain reaction.

$$RH \rightarrow R.$$

$$R. + O_2 \rightarrow ROO.$$

$$ROO. + RH \rightarrow ROOH + R.$$

$$ROOH \rightarrow RO. + .OH$$

$$RO. + RH \rightarrow ROH + R.$$

$$.OH + RH \rightarrow HOH + R.$$

Thus, the oxidation of hydrocarbon is accelerated to produce a great quantity of alcohols, aldehydes, acids and the like, and they react with each other to produce polymer. In order to prevent oxidation of hydrocarbon, it is necessary to intercept the above chain reaction, and antioxidant is used for that purpose. Besides, it is also preferable to add the following radical scavenger.

As the radical scavenger suitable for the invention, there are 1,1-diphenyl-2-picrylhydrazyl, 1.3.5-triphenyl-ferudazyl, 2.2,6.6-tetramethyl-4-piperidone-1-oxyl, N-(3-N-oxyanilino-1.3-dimethylbytylidene)anilinoxide, high valency metal salts, such as ferric chloride, diphenylpicrylhydrazine, diphenyamine, hydroquinone, t-butylcatechol, dithiobenzyldisulfide, p.p'-ditolyltrisulfide, benzoquinone derivatives, nitro compounds, nitroso compounds, and the like. Among them, to use hydroquinone is particularly preferred. The above radical scavenger may be used as a single material, or several kinds may be combined. A suitable content of the radical scavenger is 1,000 to 10,000 ppm.

As the antioxidant, there are radical group chain terminator which reacts with radical groups, mainly ROO., which are chain carriers, to inactivate them, and peroxide decomposer which decomposes hydroperoxide ROOH which is the main source of radical groups, to stabilize it. The radical group chain terminator includes alkylphenol antioxidant and aromatic amine antioxidant. The peroxide decomposer includes sulfur-containing antioxidant and phosphorus-containing antioxidant. In order to prevent yellowing or browning of resin caused by thermal degradation and generation of lumps, it is preferable to combine a radical group chain terminator and a peroxide decomposer. Since antioxidant is a reducing agent which adversely affects photographic photosensitive materials, unless its kind and the blending amount is carefully examined, degradation of photographic photosensitive materials becomes a great problem.

In order to prevent thermal degradation of thermoplastic resin, particularly polyethylene resin, it is preferable to blend 0.001 to 2 wt. %, preferably 0.005 to 0.8 wt. %, particularly preferably 0.01 to 0.5 wt. % of organic cyclic phosphorus compound as a single material or combined with other antioxidant. As the antioxidant combined therewith, it is preferable to blend 0.001 to 1 wt. %, preferably 0.005 to0.8 wt. %, particularly preferably 0.01 to 0.5 wt. %, of phenolic antioxidant, particularly hindered phenolic antioxidant, which has radical group chain terminating action different from the peroxide decomposition action of the cyclic phosphorus compound and rarely affects adversely photographic photosensitive materials. It is also preferable further to blend aforementioned radical scavenger and/or phosphoric acid, citric acid, etc. in addition to the above combination because longer continuous molding becomes possible.

Examples of suitable organic cyclic phosphorus compounds are as follows:

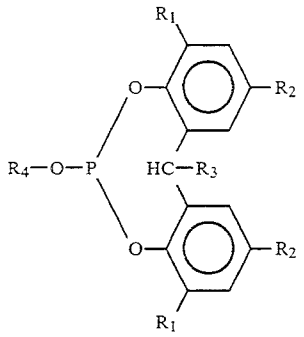

In the formula, $R_1$ represents tertiary butyl group or tertiary amyl group, $R_2$ represents alkyl group having a number of carbon atoms of 1–9, $R_3$ represents hydrogen atom or alkyl group having a number of carbon atoms of 1–4, and $R_4$ represents alkyl group having a number of carbon atoms of 1–30 or aryl group having a number of carbon atoms of 6–15.

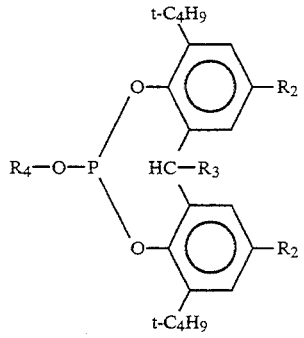

In the formula, the definition of $R_2$, $R_3$ and $R_4$ is the same as above.

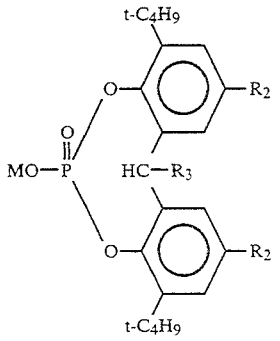

In the formula, the definition of $R_2$ and $R_3$ is the same as above. M represents alkali metal atom.

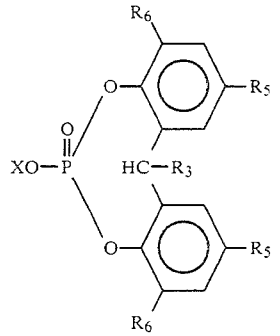

In the above formula, the definition of $R_3$ is the same as above, $R_5$ and $R_6$ represent hydrogen, atom, alkyl group, cycloalkyl group, aryl group or alalkyl group having a number of carbon atoms of 1–12, and X represents —OH group or $—O^-NH_4^+$.

In order to prevent photogradation of the container for a photographic film, it is preferable to add 0.001 to 5 wt. %, preferably 0.005 to 3 wt. %, particularly preferably 0.01 to 1 wt. %, of ultraviolet absorber. Particularly preferable ultraviolet absorbers are hindered amine ultraviolet absorbers, such as 2.2,6.6-tetramethyl-4-piperidinol, 2.2,6.6-tetramethyl-4-piperidylbenzoate, etc., and benzophenone ultraviolet absorbers.

Organic or inorganic nucleating agent may be blended for the purpose of shortening molding cycle, improving transparency, hardness and rigidity and decreasing resin remaining at gate, due to improving crystallization rate.

Preferable organic nucleating agent includes, dibenzylidenesorbitol compounds, such as 1,3,2,4-di(methylbenzylidene)sorbitol, 1,3,2,4-di(ethylbenzylidene)sorbitol, 1,3,2,4-di(propylbenzylidene)sorbitol, 1,3,2,4-di(-methoxybenzylidene)sorbitol, 1,3,2,4-di(p-methoxybenzylidene)sorbitol, 1,3,2,4-di(ethoxybenzylidene)sorbitol, 1,3,2,4-di(p-methylbenzylidene)sorbitol, 1,3,2,4-di(p-chlorobenzylidene)sorbitol, 1,3,2,4-di(alkylbenzylidene)sorbitol, 1,3,2,4-bis(methylbenzylidene)sorbitol, aluminum benzoate, and the like.

Inorganic nucleating agent includes an alkali metal hydroxide such as lithium hydroxide, sodium hydroxide and potassium hydroxide, an alkali metal oxide, such as sodium oxide, an alkali metal carbonate, such as lithium carbonate, sodium carbonate, potassium carbonate, sodium hydrogencarbonate and potassium hydrogencarbonate, an alkaline earth hydroxide, such as calcium hydroxide, magnesium hydroxide and barium hydroxide, an alkaline earth oxide, such as calcium oxide, and an alkaline earth carbonate, such as calcium carbonate.

Preferable nucleating agents are dibenzylidene sorbitol compounds.

The organic nucleating agent may be used alone, or two or more organic nucleating agents may be combined. The organic nucleating agent may be combined with an inorganic nucleating agent. The surface of the organic nucleating agent may be coated with various fatty acids, fatty acid compounds, coupling agents, surfactants or the like.

The content of the nucleating agent is 0.001 to 2 wt. %, preferably 0.005 to 1 wt. %, particularly preferably 0.01 to 0.5 wt. %. When the content is less than 0.001 wt. %, the effect of the nucleating agent is insufficient. While, when the nucleating agent is added beyond 2 wt. %, the effect of the excess amount of the nucleating agent is minor. Bleeding out increases to generate white powder problem.

As the method of blending the nucleating agent, there are the compound method, the dry blending method, the masterbatch method, and the like, and the masterbatch method is preferred. Since the nucleating agent is bulky and tends to fly away, blending in a small amount of dispersing agent or wetting agent is preferred. Suitable dispersing agents include carboxylic acid anhydrides, higher fatty acids, etc., and lubricants such as oleic amide are particularly preferred. As the wetting agent, plasticizers such as DOP and DHP can be used.

It is also preferred to prevent the bleeding out by coating or blending a fatty acid or a fatty acid compound, such as a higher fatty acid, a fatty acid amine or a fatty acid metal salt onto or with the organic nucleating agent. By blending these additives, white powder generation caused by abrasion can be decreased by increasing rigidity, and white powder generation caused by crystallization or bleeding out of the organic nucleating agent can also be decreased. Moreover, unpleasant odor from the organic nucleating agent is prevented, and mold releasability, antistatic ability and antiblocking ability are improved.

The container for a photographic film of the invention may be colored by blending various light-shielding material or various filler for the purpose of improving commercial value by rendering beautiful appearance, improving printability, discrimination of goods or light-shielding, preventing temperature rise in the container or statical electrification, improving physical strength, X-ray-shielding or the like. As the coloring method, there are mainly the following two methods. One is the compound method using uniformly colored resin pellets having the same concentration as the color density of the molded articles. The other is the masterbatch method blending color masterbatch pellets containing about 20 wt. % of coloring agent with uncolored resin pellets in the ratio so as to obtain the concentration of the molded articles and using the blended pellets for molding. Preferable method is the masterbatch method because the material cost can be decreased by 25% or more. In the masterbatch method, a tumbler mixer, an auto-coloring mixer when blends color masterbatch pellets and uncolored resin pellets uniformly a static mixer, a super nozzle which renders the resin color uniform after melting the resin, etc. are used. The resin for masterbatch contains preferably more than 50 wt. % of ethylene copolymer resin and/or low softening point (less than 100° C.) thermoplastic resin (paraffin wax, low molecular weight polyethylene resin, low molecular weight polypropylene resin, etc.).

As the light-reflective coloring agent, there are white, yellow or translucent organic or inorganic pigment or dyes. The light-reflective inorganic pigments include calcium carbonate, calcined clay, titanium dioxide, zinc oxide, barium sulfate, talc, aluminum sulfate, aluminum powder, aluminum paste, silica, etc. Among them, surface-treated titanium dioxide, calcium carbonate, barium sulfate, aluminum powder, aluminum paste and synthetic silica are preferred. Particularly, barium sulfate is suitable for the container for a photographic film for overseas trip because of having X-ray-shielding ability.

Preferable embodiments of the container body in cap separated from body type and body-cap joined type for a photographic film are enumerated below.

(1) Container body formed by injection molding using polypropylene resin composed of a thermoplastic resin having a propylene unit content of more than 50 wt. %, a MFR (ASTM D-1238) of 10 to 80 g/10 minutes, a bending elastic modulus (ASTM D-790) of not less than 7,000 kg/cm$^2$ and a notched Izod impact strength (ASTM D-256) at 23° C. of not less than 23° C.

(2) Container body comprising 50 to 95 wt. % of propylene-ethylene random copolymer resin, 5 to 50 wt. % of homopolypropylene resin and/or propylene-ethylene block copolymer resin, 0.001 to 2 wt. % of nucleating agent, 0.001 to 5 wt. % of lubricating material.

(3) Container body comprising not less than 50 wt. % of polyolefin resin, dripproofing material having dripproof action or antifog action and lubricant.

(4) Container body comprising 50 to 95 wt. % of polypropylene resin having a MFR of 8 to 80 g/10 minutes, a notched Izod impact strength at 23° C. of not less than 1.5 kg.cm/cm, a bending elastic modulus of not less than 7,000 kg/cm$^2$, 4 to 50 wt. % of ethylene-α-olefin copolymer resin and 0.001 to 5 wt. % of lubricating material.

(5) Container body comprising not less than 60 wt. % of homopolyethylene resin and/or ethylene-α-olefin copolymer resin having a MFR of 7 to 50 g/10 minutes, a density of 0.945 to 0.985 g/cm$^3$, an Olsen rigidity (ASTM D-747) of not less than 6,000 kg/cm$^2$, a Shore hardness (ASTM D-2240) of not less than 60D and a notched Izod impact strength (ASTM D-256) of not less than 2.0 kg.cm/cm. The container body may be formed of the above homopolyethylene resin alone, or ethylene-α-olefin copolymer resin alone of which the α-olefin has a number of carbon atoms of 3–10, or the above properties may be obtained by blending various additives. In the case of transparent container body, it is preferable to blend 0.001 to 2 wt. % of nucleating agent and 0.001 to 2 wt. % antioxidant.

(6) Container body comprising not less than 60 wt. % of polystyrene resin containing synthetic rubber having a MFR of 5 to 50 g/10 minutes, a density of 0.95 to 1.2 g/cm$^3$, a bending elastic modulus of not less than 11,000 kg/cm$^2$, a notched Izod impact strength of not less than 2 kg.cm/cm, a Vicat softening point of not less than 95° C. and a Rockwell hardness of not less than 60L.

(7) Container body of the above (1) to (6) further comprising 0.001 to 30 wt. % of light-shielding material, particularly light-reflective light-shielding material, such as white pigment, metal powder or light yellow pigment. Printability, light-shielding heat insulating, etc. are improved, and whitening is made inconspicuous. In the case of blending not more than 3 wt. %, dripping strength is improved. It is preferable that light-shielding material is blended in a form of masterbatch prepared by blending the light-shielding material in a high concentration (not less than 5 wt. %, preferably not less than 10 wt. %, particularly preferably not less than 20 wt. %) into ethylene copolymer resin. In the case of using carbon black, various advantages are obtained, such as improvement in dropping strength, slipping character and resistance to oxidation, shielding resin yellowing, improvement in light-shielding, etc.

(8) Condenser body comprising not less than 50 wt. %, preferably not less than 70 wt. %, particularly preferably not less than 90 wt. % of homopolyethylene resin and/or ethylene-α-olefin copolymer resin having a melt flow rate (ASTM D-1238, at 190° C. at 2.16 kg) of 5 to 40 g/10 minutes, a density of 0.950 to 0.985 g/cm$^3$, a bending rigidity (ASTM D-747) of not less than 8,000 kg/cm$^3$ and a Vicat softening point of not less than 115° C.

(9) Container body containing0.001 to 2 wt. % of antioxidant, 0.01 to 2 wt. % of nucleating agent, and 0.001 to 5 wt. % of lubricant. It is preferable in view of improvement in transparency, resistance to thermal degradation of resin and nucleating agent, injection moldability, prevention of the generation of substances which adversely affect photographic properties of photographic film, prevention of the generation of colored material.

(10) Container body formed by using a polyolefin resin composition containing 0.001 to 5 wt. %, preferably 0.01 to 2 wt. %, particularly preferably 0.05 to 1 wt. %, of metallic soap (preferably calcium stearyl lactate, calcium stearate, zinc stearate, magnesium stearate, sodium palmitate, sodium benzoate, etc.)

(11) Container body formed of a polyolefin resin composition having a heat history at not less than 190° C. once or more containing 0.01 to 2 wt. % of organic nucleating agent and 0.001 to 2 wt. % of antioxidant.

(12) Container body having a haze (measured according to ASTM D-1003 in the case of the side wall thickness of the container body of 0.5 to 1.2 mm) of not more than 70%, preferably not more than 50%, particularly preferably not more than 30%. It is preferable in order to confirm letters and marks printed on a photographic film cartridge by visual observation from the outside of the container body.

(13) Container body formed of a polyolefin resin composition containing 0.001 to 2 wt. % in the total amount of hindered phenolic antioxidant and/or phosphorus-containing antioxidant having a melting point of not less than 100° C.

(14) Container for a photographic film consisting of a container body and a cap fitted thereto, wherein the cap is formed of a polyethylene resin composition comprising more than 50wt. % of homopolyethylene resin, ethylene-α-olefin copolymer resin or a blend thereof having a melt flow rate of 5 to 60 g/10 minutes and a density of 0.90 to 0.97 g/cm$^3$, 0.001 to 2 wt. % of antioxidant and 0.001 to 5 wt. % of lubricating material.

(15) Container wherein the container body is formed of a polyethylene resin composition comprising not more than 50 wt. % of homopolyethylene resin, ethylene-α-olefin copolymer resin or a blend thereof having a melt flow rate of 5 to 80 g/10 minutes, a density of not less than 0.935 g/cm$^3$ and a bending rigidity of not less than 4,000 kg/cm$^2$, 0.01 to 2 wt. % of nucleating agent and 0.001 to 2 wt. % of antioxidant.

(16) Container wherein the container body is formed of a polyethylene resin composition comprising more than 50 wt. % of homopolyethylene resin, ethylene-α-olefin copolymer resin or a blend thereof having a melt flow rate of 5 to 80 g/10 minutes, a density of 0.941 to 0.985 g/cm$^3$, a bending rigidity of not less than 6,000 kg/cm$^2$, a Shore hardness of not less than 60D, a notched Izod impact strength at 23° C. of not less than 2.0 kg.cm/cm, a Vicat softening point of not less than 110° C. and a melting point of not less than 120° C., 0.01 to 2 wt. % of nucleating agent and 0.001 to 2 wt. % of antioxidant.

(17) Container wherein the container body is formed of a polyethylene resin composition containing 0.001 to 1 wt. % of organic cyclic phosphorus compound.

Forms and advantages of the container for a photographic film of the invention are as follows:

Body-Cap Joined Type

Recycling is possible by repelletizing because of indentical resin composition. Decorated casket can be omitted. Various thermoplastic resin compositions are usable. Polygonal (square hexagonal, octagonal) cylinder, circular cylinder, elliptical cylinder, etc.

Cap Separated from Body Type

Excellent in multi-cavity molding ability. Molding cycle can be shortened. Mold is inexpensive. When the same resin composition is used for the body and cap, recycling is possible but sealability is inferior. When different resin compositions are used for the body and the cap, sealability and openability are excellent. Conveying properties and stock ability are also excellent.

When different resin compositions are used for the body and the cap, the body can be separated from the cap by flotation by making the specific gravity difference between the body and the cap not less than 0.1 g/cm$^3$, preferably not less than 0.2 g/cm$^3$, particularly preferably not less than 0.3 g/cm$^3$, and thereby recycling becomes possible. A means for increasing the specific gravity difference is to blend a pigment. After separation, respective ones can be used again by repelletizing. When L-LDPE resin is used for the cap and a resin composition containing not less than 60 wt. % of homopolypropylene resin, propylene-α-olefin copolymer resin or homopolyethylene resin or ethylene-α-olefin copolymer resin having a density of not less than 0.94 g/cm$^3$ is used for the body, the mixture of the cap and the body can be used again as the resin for the body.

Preferred relationships between the contained body and the cap are as follows:

(1) Sealability, fitting strength, openability and handling can be made excellent by making the container body highly rigid and the cap flexible. A suitable bending rigidity ratio of the resin of the container body/the resin of the cap is not less than 1.5, preferably not less than 2, particularly preferably not less than 3.

(2) Although resin having a small bending rigidity is used as the resin of the container body, sealability can be improved by thickening the bottom or providing reinforcing ribs, increasing prssure resistance and by using resin having a greater bending rigidity than the resin of the container body (the outer diameter of the fitting part of the cap is made greater than the inner diameter of the container body). The pressure resistance is ensured by the high rigidity cap and the bottom of the container body.

(3) Both of the container body and the cap are colored. The disadvantage that the kind of the production the container cannot be discriminated from the outside of the container because of opaqueness is resolved by setting the color of the cap and/or the container body so as to represent the product in the container.

EXAMPLE

Red cap and brown body . . . Reversal film

Green cap and brown body . . . ISO Photographic speed 100 negative film

White cap and brown body . . . Microfilm

Black cap and brown body . . . ISO Photographic speed 400 negative film

Black cap and black body . . . ISO Photographic speed 800 netative film

Silver cap and silver body . . . ISO Photographic speed 1600 negative film

Using a Resin Composition having X-ray-shielding Ability (4) The same resin composition is used for the container body and the cap. Recycling is possible. Body-cap joined type is preferred.

(5) The container body can be separated from the cap during washing by the specific gravity difference by making it not less than 0.1, preferably not less than 0.2, particularly preferably not less than 0.3. Recycling is possible. The specific gravity difference is added by selecting the kind of resin, using a high specific gravity pigment or metal powder or the like.

As the form of fitting of the cap to the container body, fitting rib may be formed on either of the cap or the container body, and the form of the rib and fitting groove may be varied.

A use of the container for a photographic film of the invention is a container for a photographic film cartridge. As the container for a photographic film cartridge, there are cap separated from body fitting type and body-cap joined fitting type. The container of the invention is particularly suitable for 135 type wherein the leading end of the photographic film is previously extended out of the cartridge which is now the spread and a type wherein the leading end is wound in the cartridge and delivered by the rotation of spool (U.S. Pat. No. 4,634,306, U.S. Pat. No. 4,832,275, Japanese Patent KOKAI No. 4-320,258, etc.). When the container for a photographic film of the invention is applied for a photographic film cartridge, the form of the cartridge may be circular cylinder, square cylinder or various other form having a spool core for winding photographic film. The material may be presently used resin. The container for a photographic film of the invention is particularly effective for relatively weak cartridges such as formed of resin, because of being excellent in impact strength and compressive strength.

The total form of the container body may be designed so as to meet the form of the photographic film cartridge placed therein, and may be cylinder including circular cylinder and elliptical cylinder, polygonal cylinder and the like.

Moreover, the container of the invention is also applicable to containers for microfilm, containers for long negative film for movie photographing wound around a core, 16 mm negative photographic films placed in a cartridge (instamatic film), brownie size films, etc.

It is preferable that the container for a photographic film is produced by pelelletizing the resin for forming the container, and pneumatically conveying the pellets from the container to the hopper of a molding machine in a sealed state, in view of preventing contamination with impurities, such as sand, pebble, paper fiber, dust, radioactive dust, etc. That is, by conveying the thermoplastic resin in a sealed state preventing from contamination with foreign materials (pellets transported from a resin manufacturer in a state of sealing in a container is conveyed through a pipe, provisionally stocked in a silo, and then supplied to a hopper of molding machine by an outomatic roller conveyor), continuous molding is possible without molding troubles, such as short shot or not shot, due to gate clogging.

A suitable length diameter ratio of the pellet of the resin for molding the container is 0.1 to 15, preferably 0.3 to 5. The form of the pellet may be circular cylinder, polygonal cylinder, fusiform, ellipsoid or the like.

A suitable mold for forming the container for a photographic film has the gate at almost the center of the lower part of the container body, is composed of a female mold (cavity) of which the outer surface is made a roughened face with a depth of 0.001 to 5 μm and a male mold (core) of which the inner surface is made roughened face with a depth of 0.001 to 5 μm has a cavity of 0.4 to 1.2 mm in width therebetween, and is provided with notches for venting at an end of the cavity at the split face of the mold. The form and size of the notches for vent are not particularly limited. However, it is necessary to design the notches so that the vent effect is great, and nevertheless, the trouble of escaping the molten resin from the notches (burns). Actually, a suitable notch has a mean depth of 0.001 to 5 μm, preferably 0.005 to 2.5 μm, particularly preferably 0.01 to 1 μm, and a notched width of not less than 1 μm, preferably not less than 1000 μm, particularly preferably 0.5 to 5 mm, in view of the balance between the prevention of burns and the vent effect.

The container for a photographic film of the invention may be provided with various indications, such as indication of content, instructions of use, bar code and the like by printing, placing in a packaging material with print (bag, wrapping, shrink packaging, packaging box, etc.). By placing in the packaging material, protection of the container for a photographic film of the invention is improved, and virginity of goods can be ensured. Decoration can also be added. As the packaging film, shrinkable film is preferred, and generally known shrinkable films, such as made of polyvinyl chloride, polyester, polypropylene or polyethylene, are usable. Taking recycling into consideration, the material of the shrinkable film is preferably similar to the container body and the cap.

The packaging film may be provided with a means for facilitating opening. Such a means may be an opening tape, perforations, an easily peelable portion or the like. The means for facilitation opening may be provided circumferentially or partly, at one part of plural parts.

The packaging box is preferably formed of a combination paper composed of three layers. The paper may be formed at the time of paper making or formed by lamination through an adhesive layer. Both surface layers of the combination paper having printability are formed of white paper made of bleached virgin pulp which may be acidic paper or neutral paper, or waste paper of fine paper. The middle layer may be formed of unattractive paper inferior in printability, such as waste paper of news paper, corrugated board or the like, high yield pulp (frequently used for copying), unbleached or semibleached kraft paper, bray board paper, regenerated paper used in magazine, etc. The blending amount of waste paper can be up to about 60 wt. % of the combination paper. The printing face is preferably formed of a mirror-coated paper, clay-coated paper, art paper or the like, in view of attractiveness, printability, wear resistance and the like. The packaging box is also preferably provided with a means for facilitating opening, such as perforations similar to the case of wrapping film.

The container for a photographic film of the invention may be sealed by a band seal between the container body and the cap. Preferred band seals are formed of paper, synthetic paper, nonwoven fabric, plastic film, laminated film or the like, on which the surface is printed, and a sealable adhesive, such as heat-sensitive adhesive, pressure-sensitive adhesive, hot-melt adhesive or other adhesive, is provided on the container body portion.

In the container for a photographic film of the invention, the roughened face makes entering of air possible, and improves wear resistance and slipping character. The roughened face also facilitate the escape of volatile components in the resin composition through the notches for vent.

In the container for a photographic film of the invention, buckling, bottom sink mark, deformation and the like do not occur at the time of molding, bursting sound does not generate at the time of extracting the core from the container body.

Some containers for a photographic film embodying the invention are illustrated in FIGS. 1 through 10.

The container 1 for a photographic film of FIG. 1 is composed of a container body 2 and a cap 3, and the inner surface of the container body 2 is a roughened face 4 by forming lateral fine ribs.

The container 1 for a photographic film of FIG. 2 is also composed of a container body 2 and a cap 3, and the inner surface of the container body 2 is a roughened face 4 by forming longitudinal fine ribs.

The container 1 for a photographic film of FIG. 3 is in a body-cap joined type, and the cap 3 portion is joined to the container body 2 portion through a hinge 5. The inner surface of the container body 2 portion is a roughened face 4 by forming fine ribs in a lattice from.

FIGS. 4 through 8 illustrates various modification of the total form of the container for a photographic film to which the present invention is applicable. The container 1 for a photographic film of FIG. 4 is formed in a circular cylinder, and the cap 3 portion is joined to the container body 2 portion through a hinge 5. In the container 1 for a photographic film of FIG. 5, the outside of the container body 2 is formed into a rectangular parallelopiped, and the inside for placing a photographic film is formed into a circular cylinder. The container 1 for a photographic film of FIG. 6 is in a fitting type of a cap 3 to a container body 2. The container 1 for a photographic film of FIG. 7 is for containing a roll of a long photographic film (microfilm), and the cap 3 portion is joined to the container body 2 portion through a hinge 5. The container 1 for a photographic film of FIG. 8 is composed of a rectangular container body 2 portion with an almost cylindrical inside and a cap 3 portion in a plate form joined thereto through a hinge 5.

As essential part of a molding apparatus for molding a container body of the container for a photographic film of the invention is shown in FIG. 9. In the apparatus, a female mold 11 and a male mold 12 are integrated into a mold 13. The part of the mold 13 corresponding to the end of the container body is provided with notches so as to form notches for vent. The molten resin is injected from the nozzle 14. The container body molded by this apparatus is provided with notches in a square U form as shown in FIG. 10.

A procedure of transporting resin form forming a container for a photographic film is illustrated in FIG. 11. The resin in a form of pellet is put in a container 20, and transported from a resin manufacturer by an autotruck. The container 20 is connected to a silo 21 by a pneumatic pipe 25. The silo 21 is connected to a hopper 26 with automatic rollers of plural injection molding machines 22 by a pneumatic pipe 25. Molded container bodies are conveyed by a pneumatic conveyor 27 to provisional hoppers 23,24 through a pneumatic pipe 25, and then conveyed to an apparatus 28 for putting a photographic film into the container body, and then fitting a cap. Preferable materials of the pneumatic pipes are stainless steel, polyethylene resin having a density of not less than 0.935 g/cm$^3$, preferably high density polyethylene resin having a density of not less than 0.941 g/cm$^3$, particularly preferably not less than 0.950 g/cm$^3$, containing lubricant or carbon black.

Some packages of a photographic film embodying the invention are illustrated in FIGS. 12 through 24.

Figure 12:
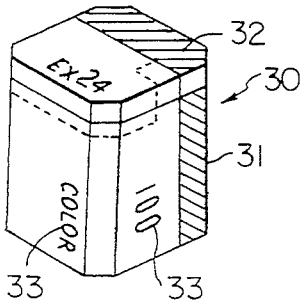

In the package 30 of a photographic film of FIG. 12, the whole surface of a container for a photographic film is wrapped by a moistureproof shrinkable film 31, and provided with an opening means 32 for facilitating opening and print 33.

Figure 15:
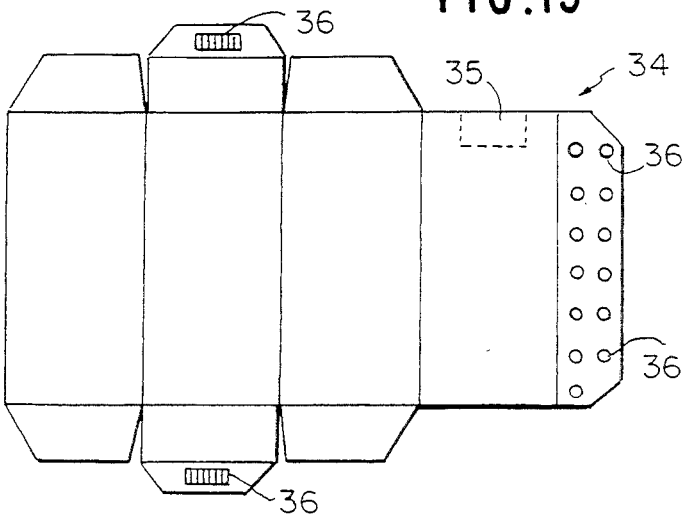
FIG. 15 is a development of the packaging box of the package for a photographic film of FIG. 13.
Figure 13:
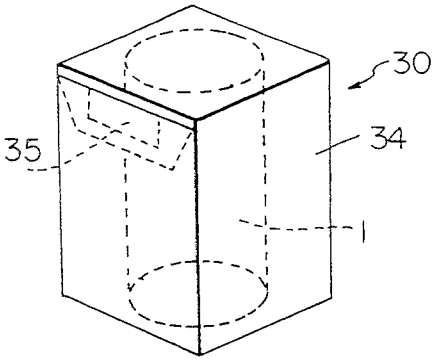
Figure 14:
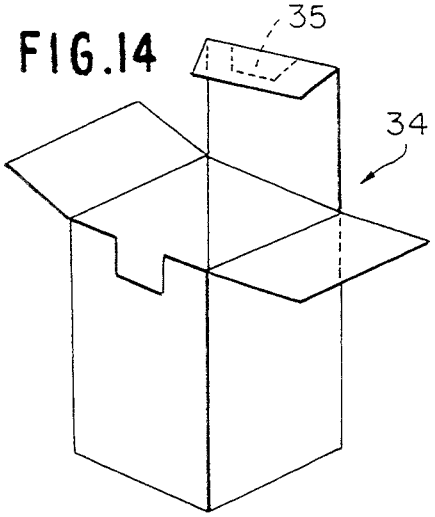
FIG. 14 is a perspective view of the package for a photographic film of FIG. 13 in an opened state.

The package 30 of a photographic film of FIG. 13 is formed of a packaging casket 34 provided with an opening means 35 containing a container 1 for a photographic film. An opened state of the casket 34 is shown in FIG. 14, and a developed state of the casket 34 is shown in FIG. 15. The casket 34 made of paper is opened at the top portion, and the opening means 35 is formed on a side portion near the top. The casket is fabricated by joining using adhesive 36.

Figure 16:
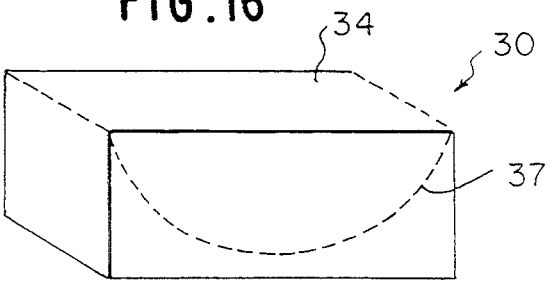
Figure 17:
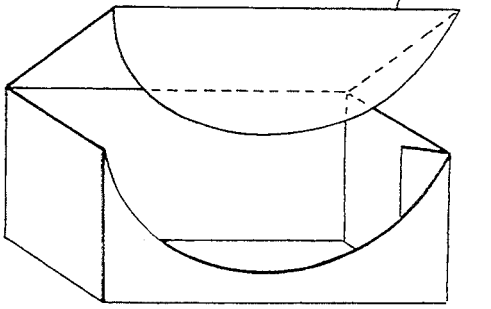
FIG. 17 is a perspective view of the package for a photographic film of FIG. 16 in an opened state.

The packages 30 of a photographic film of FIG. 16 is formed of an oblong rectangular paraletlopiped casket 34 made of paper, and perforation line is formed on both upper side edges opposite to each other and on the front in arc connecting both upper corners as an opening means 37. An opened state of the casket 34 is shown in FIG. 17, and a developed state of the casket 34 is shown in FIG. 18.

The package 30 of a photographic film of FIG. 19 is formed of a rectangular parallelopiped casket 34 made of paper, and perforation line is formed on both upper side edges opposite to each other and on the front and the rear each in arc connecting both upper corners as an opening means 37. An opened state of the casket 34 is shown in FIG. 20, and a developed state of the casket 34 is shown in FIG. 21.

Figure 22:
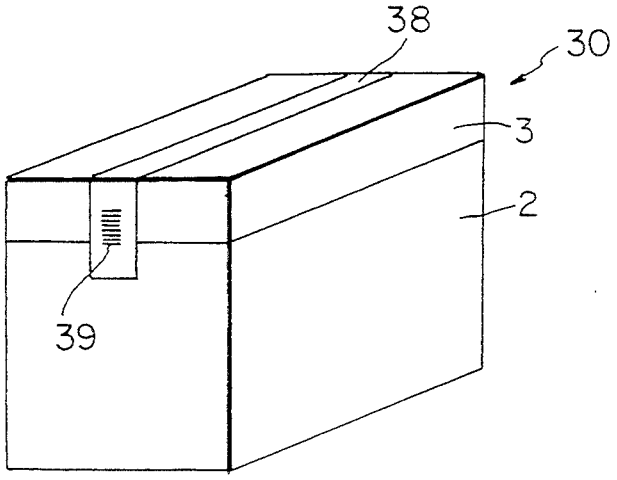

In the package 30 of a photographic film of FIG. 22, a band seal 38 is adhered to a container for a photographic film composed of a container body 2 and a cap 3 to fix them integrally. The band seal 38 is provided with a bar code 39.

Figure 23:
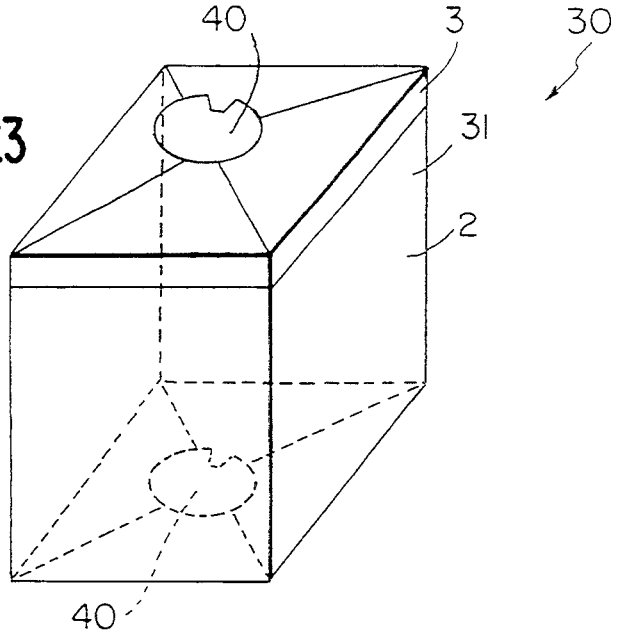

In the package 30 of a photographic film of FIG. 23, a container for a photographic film composed of a container body 2 and a cap 3 is wrapped by a moistureproof shrinkable film 31, and both ends of the film 21 are fixed by a seal 40.

Figure 24:
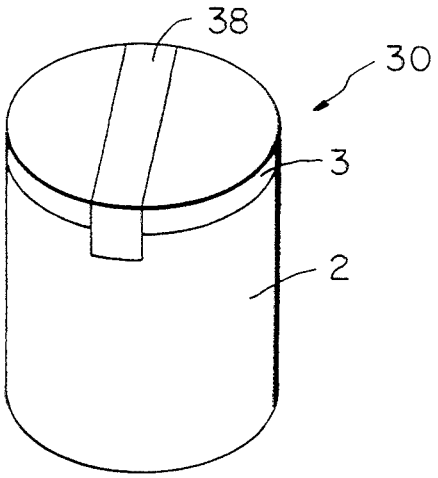

In the package 30 of a photographic film of FIG. 24, a container body 2 and a cap 2 of a container for a photographic film are fixed by a band seal 38.

EXAMPLES

Example 1

Both of resin pellets for container body and those for cap were put in a sealed container, and conveyed from a resin manufacturer to the hopper of a molding machine in a complete sealing system.

A propylene-ethylene random copolymer resin composition used was composed of 99.7 wt. % propylene-ethylene random copolymer having a melt flow rate (MFR, ASTM D-1238) of 25 g/10 minutes at 230° C. at a loading of 2.16 kg, a density (ASTM D-1505) of 0.90 g/cm$^2$, an initial bending elastic modulus (ASTM D-790) of 13,200 kg/cm$^2$, a notched Izod impact strength (ASTM D-256) of 6 kg.cm/cm at 23° C., a Rockwell hardness (ASTM D-785) of 86R, a Vicat softening point (ASTM D-1525) of 150° C. and an ethylene content of 3.5 wt. %, 0.05 wt. % of oleic amide lubricant, 0.05 wt. % of phenolic antioxidant and 0.2 wt. % of 1.3,2.4-dibenzylidenesorbitol. Using the above resin composition, container bodies having a form of FIG. 1 were formed by injection molding using a 24-cavity mold in a hot runner type at a resin temperature of 200° C.

Both of the inner surface and the outer surface of the container body were roughened by forming lateral ribs 0.1 μm in height in the circumferential direction.

Caps having a form of FIG. 1 were formed by injection molding using a low density homopolyethylene resin composition composed of 99.9 wt. % of high pressure low density homopolyethylene resin having a MFR (ASTM D-1238) of 30 g/10 minutes at 190° C. at a loading of 2.16 kg and a density (ASTM D-1505) of 0.926 g/cm$^3$, 0.05 wt. % of erucic amide lubricant and 0.05 wt. % of phenolic antioxidant using a 24-cavity mold in a hot runner type.

In the container body of this example, buckling and bottom sink mark did not occur at all. Sound was not generated even in the moment of extracting the core (male mold) from the container body. The container body was excellent in transparency. In the cap, molding troubles, such as deformation, and coloring trouble in stops by resin yellowing did not occur. Both of the container body and the cap could be continuously molded more than 1 month until routine cleaning. They are excellent in sealability, fitting of the cap to the container body, insertion of a photographic film cartridge and conveying properties.

COMPARATIVE EXAMPLE 1

Using the same resin composition for container body as Example 1, container bodies were molded in the same manner as Example 1, except that both of the inner face and the outer face of the peripheral wall were almost a mirror face wherein the unevenness in the circumferential direction was less than 0.001 μm.

In the container body, bursting pop sound occurred every time in the moment of extracting the core from the container body to degrade working environment. Buckling and bottom sink mark occasionally occurred caused by the moment reduced pressure on the inside of the container body at the time of extracting the core, and abrasion also occurred by the core.

COMPARATIVE EXAMPLE 2

Container bodies were molded in the same manner as Comparative Example 1, except that the resin composition used did not contain 0.05 wt. % of oleic amide lubricant. Both of the inner face and the outer face of the peripheral wall were almost a mirror face wherein the unevenness was less than 0.001 μm.

The delivery of the resin pellets were not smooth from the hopper mounted on the molding machine to the molding machine, and the injected quantity was unstable. Moreover, bursting pop sound occurred every time in the moment of extracting the core from the container body, and working was difficult, unless workers wore ear plugs. Buckling and bottom sink mark frequently occurred. In the cap not containing lubricant, defromation frequently occurred, and molding cycle needed to be greatly extended.

Example 2

A white color polyolefin resin composition used was composed of 59.5 parts by weight of ethylene-butene-1 copolymer resin having a MFR of 20 g/10 minutes, a density of 0.940 g/cm$^3$, an Orsen bending rigidity (ASTM D-757) of 6100 kg/cm$^2$, 40 parts by weight of a light-shielding material masterbatch resin composed of 50 wt. % of starch of which the surface was treated with silicone oil, 40 wt. % of adhesive polyethylene resin and 10 wt. % of paraffin wax, 0.05 part by weight of oleic amide, 0.05 part by weight of phenolic antioxidant, 0.2 part by weight of 1.3,2.4-dibenzylidenesorbitol and 0.2 part by weight of glycerol monostearate. Using the above resin composition, containers for a photographic film in body-cap joined type having a form of FIG. 3 were formed by injection molding.

The inner surface of the container body portion was roughened by forming lattice 0.1 μm in height, and the outer surface of the container body portion was also roughened by forming lattice 0.05 μm in height.

Since the container could exhibit foth functions of a conventional decorated paper casket and a container, industrial waste could be decreased by omitting the casket. Since both of the cap portion and the body portion had the same resin composition, recycling was possible. Air entered into the container body portion through the roughened face in the moment of extracting the core therefrom, and accordingly, sound, buckling and bottom sink mark did not occur because of no formation of reduced pressure donditions. As a result, molding cycle could be shortened. The container was excellent in dripproofness, and moreover, the container discarded after use was decomposed through biodegradation, because of containing 25 wt. % of starch, which had hygroscopicity and biodegradation ability in the resin composition. The container was white opaque due to the combination of silicone oil and starch, and the outer surface was roughened to form lattice with 0.05 μm in height. As a result, the container was printable, and it was not necessary to use a decorated casket. Thus, the container was excellent in the reduction of cost, the decrease of industrial waste, and recycling.

Example 3

A propylene-ethylene random copolymer resin composition used was composed of 87.3 parts by weight of propylene-ethylene random copolymer resin having a MFR of 50 g/10 minutes, a density of 0.90 g/cm$^3$, an initial bending elastic modulus of 9,800 kg/cm$^2$ a notched Izod impact strength (ASTM D-256) of 4.0 kg.cm/cm at 23° C., a Rockwell hardness of 72R, a Vicat softening point of 132° C. and an ethylene content of 2.5 wt. %, 10 parts by weight of an aluminum paste masterbatch resin composed of 20 wt. % of aluminum paste and 80 wt. % of ethylene-ethyl acrylate resin, 0.05 part by weight of oleic amide, 0.2 part by weight of stearic acid monoglyceride, 0.05 part by weight of phenolic antioxidant, 0.05 part by weight of phosphorus-containing antioxidant and 2.5 parts by weight of calcium carbonate (nucleating agent). Using the above resin composition, container bodies for a photographic film corresponding to FIG. 1 were formed by injection molding using a 24-cavity mold in a hot runner type at a resin temperature of 180° C.

The inner surface of the container body was roughened by forming longitudinal ribs 0.8 μm in height, and the outer surface was roughened by forming lattice 0.03 μm in height.

5 wt. % of the aluminum paste masterbatch resin (aluminum paste content: 20 et. %) used for coloring the container body in this example was mixed with 95 wt. % of the high pressure low density polyethylene resin composition used in Example 1 in a form of pellets by using an automatic mixer with metering auto-coloring, and kneaded uniformly by the screw of the molding machine, and formed into the form of FIG. 1 by injection molding using a 24-cavity mold in a hot runner type at a resin temperature of 170° C.

The container body obtained was excellent in injection moldability, physical strength, moistureproofness and heat insulation, and had a high commercial value with beautiful appearance. Particularly, the generation rate of cracks and pinholes when the container body containing at 35 mm negative photographic film of 36 exposures fitted with the cap was dropped from 5 m height at 0° C. was decreased to less than ⅓ compared with the container body formed of the same resin composition except that the aluminum paste masterbatch resin was removed. Sound was not generated in the moment of extracting the core from the container body, and buckling and bottom sink mark did not occur. Coloring troubles by resin yellowing were within a practical range (by the coloring of aluminum paste), and continuous injection molding was possible. It was also excellent in sealability, fitting ability of the cap to the container body, insertion of a photographic film cartridge, and conveying properties.

Example 4

A propylene-ethylene random copolymer resin composition used was composed of 87.3 parts by weight of propylene-ethylene random copolymer resin having a MFR of 50 g/10 minutes, a density of 0.90 g/cm$^3$, an initial bending elastic modulus of 9,800 kg/cm$^2$ a notched Izod impact strength (ASTM D-256) of 4.0 kg.cm/cm at 23° C., a Rockwell hardness of 72R, a Vicat softening point of 132° C. and an ethylene content of 2.5 wt. %, 10 parts by weight of an aluminum paste masterbatch resin composed of 20 wt. % of aluminum paste and 80 wt. % of ethylene-ethyl acrylate resin, 0.05 part by weight of oleic amide, 0.2 part by weight of stearic acid monoglyceride, 0.05 part by weight of phenolic antioxidant, 0.05 part by weight of phosphorus-containing antioxidant and 2.5 parts by weight of calcium carbonate (nucleating agent). Using the above resin composition, container bodies for a photographic film corresponding to FIG. 1 were formed by injection molding using a 24-cavity mold in a hot runner type at a resin temperature of 180° C.

The inner surface of the container body was roughened by forming lattice composed of lateral ribs 0.2 μm in height and longitudinal ribs 0.55 μm in height, and the other surface was roughened by forming lateral ribs 0.1 μm in height.

The cap used was the same as Example 1.

The container body obtained was excellent in injection moldability, physical strength, moistureproofness and heat insulation, and had a high commercial value with beautiful appearance. Particularly, the generation rate of cracks and pinholes when the container body containing at 35 mm negative photographic film of 36 exposures fitted with the cap was dropped from 5 m height at 0° C. was decreased to less than ⅓ compared with the container body formed of the same resin composition except that the aluminum paste masterbatch resin was removed. Sound was not generated in the moment of extracting the core from the container body, and buckling and bottom sink mark did not occur. Coloring troubles by resin yellowing were within a practical range (by the coloring of aluminum paste), and continuous injection molding was possible. It was also excellent in sealability, fitting ability of the cap to the container body, insertion of a photographic film cartridge, and conveying properties.

Example 5

A propylene-ethylene random copolymer resin composition used was compared of 99.84 wt. % of propylene-ethylene random copolymer resin having a MFR of 22 g/10 minutes, a density of 0.90 g/cm$^3$, an initial bending elastic modulus of 9,200 kg/cm$^2$ a notched Izod impact strength (ASTM D-256) of 4.3 kg.cm/cm at 23° C., a Rockwell hardness of 72R, a Vicat softening point of 136° C. and an ethylene content of 4.0 wt. %, 0.10 wt. % of oleic amide lubricant, 0.03 wt. % of phenolic antioxidant and 0.03 wt. % of phosphorus-containing antioxidant. Using the above resin composition, container bodies for a photographic film shown in FIG. 1 were formed by injection molding using a 24-cavity mold in a hot runner type at a resin temperature of 190° C.

The inner surface of the container body was roughened by forming lateral ribs 0.3 μm in height, and the outer surface was roughened by forming lateral ribs 0.3 μm in height.

The cap used was the same as in Example 1.

In the container body of this example, buckling and bottom sink mark was not occur at all. Sound did not generated even in the moment of extracting the core from the container body. The container body was excellent in transparency. Moreover, the container body was excellent in sealability, and when the container body containing a 35 mm negative photographic film of36 exposures fitted with the cap was dropped from 5 m height to concrete floor cracks and cap detachment did not occur.

Example 6

A propylene-ethylene block copolymer resin composition used was composed of 96.7 wt. % of propylene-ethylene block copolymer resin having a MFR of 45 g/10 minutes, a density of0.90 g/cm$^3$, an initial bending elastic modulus of 13,000 kg/cm$^2$ a notched Izod impact strength of 3.3 kg.cm/cm at 23° C., a Rockwell hardness of95R, a Vicat softening point of 150° C. and an ethylene content of 4.0 wt. %, 0.05 wt. % of oleic amide lubricant, 0.05 wt. % of phosphorus-containing antioxidant, 3 wt. % of surface-treated titanium dioxide, 0.2 wt. % of stearic acid monogluceride dripproof agent and 0.2 wt. % of dibenzylidenesorbitol compound. Using the above resin composition, containers for a photographic film in body-cap joined type having a form of FIG. 3 were formed by injection molding.

The inner surface of the container body portion was roughened by forming a longitudinal ribs 0.2 μm in height, and the outer surface of the container body portion was also roughened by forming longitudinal ribs less than 0.001 μm in height.

Since the container could exhibit both functions of a conventional decorated paper casket and a container, industrial waste could be decreased by omitting the casket. Since both of the cap portion and the body portion had the same resin composition, recycling by repelletizing was possible. Air entered into the container body portion through the roughened face in the moment of extracting the core therefrom, and accordingly, sound, buckling and bottom sink mark did not occur because of no formation of reduced pressure conditions. As a result, cooling time could be sharply shortened resulting in shortening molding cycle could be shortened sharply to less than ½ of Comparative Example 3. Since the used resin was propylene-ethylene block copolymer resin having a high haze, i.e. 56% in the thickness of 0.3 mm, the container could be imparted with complete light-shielding ability by blending 3 wt. % of surface-treated titanium dioxide white pigment. Even when the container containing a 35 mm photographic film of 36 exposures in a sealed package condition was left under the sunlight of 80,000 luxes for 3 hours the inside temperature of the container was only 29° C. As a result, degradation in quality of the photographic film and thermal deformation of spool did not occur, and generation of water drops could not be found on the inner surface of the peripheral wall portion of the container by visual observation.

Besides, by wrapping to seal the container with a shrinkable film for visually proving that the integrity of the container had not been compromised, conventional decorated casket could be omitted resulting in the decrease of industrial waste and cost.

Moreover, even when the container was dropped from 5 m height to concrete floor in the state of containing a 35 mm negative film of 36 exposures, crack did not occur and whitening was inconspicuous in a practical level.

COMPARATIVE EXAMPLE 3

A container for a photographic film having a structure shown in FIG. 3 was formed using the same resin composition as Example 6, except that 0.05 wt. % of leic amide as a slipping character-improving material, 0.2 wt. % of stearic acid monoglyceride driproofing agent and 3 wt. % of surface-treated titanium dixoide were removed from the propylene-ethylene block copolymer resin composition by injection molding.

The container was in body-cap joined type, and both of the inner surface and the outer surface of the peripheral wall portion of the container body portion were roughened by forming longitudinal ribs less than 0.001 ρm in height.

The container was translucent, and the inside temperature of the container rose to 78° C. by leaving under the sunlight of 80,000 luxes for 3 hours in a sealed package state containing a 35 mm negative photographic film of 36 exposures. As a result, degradation in quality of the photographic film occurred, such as reduction of sensitivity and tone change. Moreover, deformation of spool occasionally occurred, and generation of water drops was frequently occurred on the inner surface of the peripheral wall portion of the container. When the container was dropped from 5 m height to concrete floor in the state of containing a 35 mm negative photographic film of 36 exposures, although crack did not occur, the impacted part was whitened to degrade appearance. When the core was extracted from the container body portion, great bursting sound occurred. Buckling and bottom sink mark also occurred to a certain degree.

Example 7

A light-shielding high density homopolyethylene (HDPE) resin composition used was composed of 99.5 wt. % of HDPE resin having a MFR of 15 g/10 minutes, a density of 0.960 g/cm$^3$, a bending rigidity of 9,500 kg/cm$^2$, a Shore hardness (ASTM D-2240) of 72D, a notched Izod impact strength at 23° C. of 3.8 kg.cm/cm and a Vicat softening point of 125° C. and 0.5 wt. % furnace-type carbon black of which the surface was coated with oleic acid monoglyceride. Using the light-shielding HDPE resin composition, container bodies corresponding to FIG. 1 were formed by injection molding using a 24-cavity mold in a hot runner type at a resin temperature of 180° C.

The inner surface of the container body was roughened by forming longitudinal ribs less than 0.15 um in height, but the outer surface was not roughened.

A light-shielding low density homopolyethylene (LDPE) resin composition was composed of 98.7 wt. % of LDPE resin having a MFR of 38 g/10 minutes and a density of 0.925 g/cm$^3$, 0.2 wt. % of oleic acid monoglyceride, 0.05 wt. % of phenolic antioxidant, 0.05 wt. % of stearic amide and 1.0 wt. % of furnace-type carbon black. Using the light-shielding LDPE resin composition, caps shown in FIG. 1 were formed by injection molding using a 24-cavity mold in a hot runner type.

In the container body of this example, buckling and bottom sink mark did not occur, and sound did not occur at the time of extracting the core from the container body. The container was excellent in sealability, light-shielding and dropping strength.

Example 8

A light-shielding polystyrene resin composition was composed of 96.0 wt. % of high impact polystyrene resin having a MFR of 15 g/10 minutes, a density (ASTM D-792) of 1.07 g/cm$^3$, a bending rigidity (ASTM D-790) of 22,000 kg/cm$^2$, a Vicat softening point of 107° C. and a Rockwell hardness of 80L containing 3 wt. % of butadiene rubber, 2.0 wt. % of dimethylpolysiloxane and 2.0 wt. % of surface-treated titanium dioxide. Using the light-shielding polystyrene resin composition, container bodies corresponding to FIG. 1 were formed by injection molding using a 24-cavity mold in a hot runner type at a resin temperature of 170° C.

Both of the inner surface and the outer surface of the container body was roughened by forming longitudinal ribs 1.0 μm in height.

A light-shielding LDPE resin composition was composed of 97.9 wt. % of LDPE resin having a MFR of 32 g/10 minutes a density of 0.925 g/cm$^3$ a bending rigidity of 3,200 kg/cm$^2$, a Vicat softening point of 102° C. and a Shore hardness of 58D, 0.05 wt. % of oleic amide, 0.05 wt. % of phenolic antioxidant, 0.2 wt. % of sorbitan monooleate ester dripproofing agent and 2.0 wt. % of surface-treated titanium dioxide. Using the light-shielding LDPE resin composition, caps shown in FIG. 1 were formed by injection molding using a 24-cavity mold in a hot runner type.

In the container body of this example, buckling, bottom sink mark and sound at the time of extracting the core from the container body did not occur. Even when the container containing a 35 mm negative photographic film of 36 exposures in a sealed package condition was left under the sunlight of 80,000 luxes, the inside temperature of the container was only 32° C. As a result, degradation in quality of the photographic film and thermal deformation of spool did not occur, and water drops did not generate on the inner surface of the peripheral wall portion of the container. Heretofore, it was believed that unless the container is excellent in moistureproofness, it is difficult to secure the quality of the photographic film in the container, and polyolefin resins were used for making such a container body. However, the moistureproofness of the container body made of polystyrene resin of this example was inferior to Examples 1-6, and the moisture permeability was about 10 times as much as those of Examples 1-6. Nevertheless, degradation in quality of photographic film did not occur. It is considered that the reason is, when the inside temperature of the container rose, moisture which degrades photographic properties of the photographic film was effused out of the container through the peripheral wall portion of the container body.

In the container body of this example, since amorphous polystyrene resin was used, the plasticizing temperature was about ½ of conventional crystalline polypropylene or polyethylene resin. As a result, the amorphous polystyrene resin was advantageous in energy cost and molding cycle, and moreover, it was also excellent in dimensional stability. Thus, it was found that the amorphous polystyrene resin is preferable as the resin for the container of the invention.

Example 9

A propylene-ethylene copolymer resin composition was composed of 80 wt. % of propylene-ethylene random copolymer resin having a MFR of 35 g/10 minutes, a density of 0.90 g/cm$^3$, a bending elastic modulus of 10,300 kg/cm$^2$, an Izod impact strength at 23° C. of 3.5 kg.cm/cm a haze of 13% and an ethylene content of 2.1 wt. % containing 0.1 wt. % (0.08 wt. % of the resin composition) of erucic amide, 0.15 wt. % (0.12 wt. % of the resin composition) of 1.3,2.4-di(methylbenzylidene)-sorbitol and 0.1 wt. % (0.08 wt. % of the resin composition) of phenolic antioxidant and 20 wt. % of propylene-ethylene block copolymer resin having a MFR of 27 g/10 minutes, a density of 0.90 g/cm$^3$, a bending elastic modulus of 12,100 kg/cm$^2$, an Izod impact strength at 23° C. of 5.7 kg.cm/cm, a haze of 83% and an ethylene content of 3.7 wt. %.

Using the above resin composition, container bodies for a photographic film shown in FIG. 1 were formed by using a toggle type injection molding machine ("NESTAL", Sumitomo Heavy Industries) with a hot runner type mold having a number of cavities of 24 at a mold clamping pressure of 150 t at a resin temperature of 220° C.

The inner surface was roughened by forming longitudinal ribs 0.25 μm in height, and the outer surface was roughened by forming longitudinal ribs 0.15 μm in height.

A light-shielding LDPE resin composition was composed of 98.7 wt. % of LDPE resin having a MFR of 38 g/10 minutes and a density of 0.925 g/cm$^3$, 0.2 wt. % of oleic acid monoglyceride, 0.05 wt. % of phenolic antioxidant, 0.05 wt. % of stearic amide and 1.0 wt. % of furnace type carbon black. Using the above resin composition, caps shown in FIG. 1 were formed by injection molding using a 24-cavity mold in a hot runner type.

In the container body of this example, buckling and bottom sink mark did not occur, and sound did not occur at the time of extracting the core from the container body. The container was excellent in sealability, light-shielding and dropping strength.

Example 10

A polypropylene resin composition was composed of 99.27 wt. % of propylene-ethylene random copolymer resin having a MFR of 35 g/10 minutes, a density of 0.90 g/cm$^3$, a bending elastic modulus of 11,300 kg/cm$^2$, a notched Izod impact strength at 23° C. of 3.6 kg.cm/cm, a Rockwell hardness of 88R and an ethylene content of 2.7 wt. %, 0.05 wt. % of bis fatty acid amide, 0.3 wt. % of a mixture of glycerol monostearate and glycerol distearate, 0.15 wt. % of N,N'-bis(2-hydroxyethyl)stearylamine, 0.1 wt. % of 1.3,2.4-di(methylbenzylidene)sorbitol and 0.1 wt. % of tetrakis [methylene-3-(3',5'-di-tert-butyl-4-hydroxyphenyl)propionate]methane.

Using the above resin composition, containers for a photographic film in body-cap joined type shown in FIG. 1 were formed by using a closed system type injection molding machine ("NESTAL", Sumitomo Heavy Industries) with a hot runner type mold having a number of cavities of 24 at a mold clamping pressure of150 t at a resin temperature of 210° C.

The inner surface was roughened by forming longitudinal ribs 0.25 μm in height, and the outer surface was roughened by forming longitudinal ribs 0.15 μm in height.

A light-shielding LDPE resin composition was composed of 98.7 wt. % of LDPE resin having a MFR of 38 g/10 minutes and a density of 0.925 g/cm$^3$, 0.2 wt. % of oleic acid monoglyceride, 0.05 wt. % of phenolic antioxidant, 0.05 wt. % of stearic amide and 1.0 wt. % of furnace type carbon black. Using the above resin composition, caps shown in FIG. 1 were formed by injection molding using a 24-cavity mold in a hot runner type.

In the container body of this example, buckling and bottom sink mark did not occur, and sound did not occur at the time of extracting the core from the container body. The container was excellent in sealability, light-shielding and dropping strength.

Example 11

A HDPE resin composition was composed of 99.3 wt. % of HDPE resin having a MFR of 20 g/10 minutes, a density of 0.967 g/cm$^3$, a bending rigidity of 14,200 kg/cm$^2$, a Shore hardness of 70D, a notched Izod impact strength at 23° C. of 7.0 kg.cm/cm, a Vicat softening point of 128° C., a melting point of 137° C. and an elongation at breakage (ASTM D-638) of more than 500%, 0.1 wt. % of a hindered phenolic antioxidant of pentaerythrityl-tetrakis[3-(3,5di-t-butyl-4-hydroxyphenyl)propionate]methane, 0.05 wt. % of a phosphorus-containing antioxidant of tris(2,4-di-t-butylphenyl)phosphite, 0.2 wt. % of an organic nucleating agent of 1.3,2.4-di(para-methylbenzylidene)sorbitol ("Gel All MD", New Japan Chemical), 0.1 wt. % of calcium stearyl lactate and 0.05 wt. % of erucic amide as lubricant, and 0.2 wt. % stearic acid monoglycerides as dripproofing agent.

Using the above resin composition, container bodies for a photographic film shown in FIG. 1 were formed by using a toggle type injection molding machine ("NESTAL", Sumitomo Heavy Industries) with a hot runner type mold having a number of cavities of 24 at a mold clampig pressure of 150 t at a resin temperature of 200° C.

The inner surface was roughened by forming longitudinal ribs 0.35 μm in height, and the outer surface was roughened by forming longitudinal ribs 0.20 μm in height.

Caps were formed of the same resin composition as Example 1 shown in FIG. 1 by injection molding using a 24-cavity mold in a hot runner type.

In the container body of this example, buckling and bottom sink mark did not occur, and sound did not occur at the time of extracting the core from the container body. The design and letters of the photographic film cartridge placed in the container could be seen sharply from the outside of the container body. The container was excellent in sealability, light-shielding and dropping strength.

Example 12

A HDPE resin composition was composed of 98.3 wt. % of HDPE resin having a MFR of 14 g/10 minutes, a density of 0.965 g/cm$^3$, a bending rigidity of 13,500 kg/cm$^2$, a Shore hardness of 72D, a notched Izod impact strength at 23+ C. of 5.3 kg.cm/cm, a Vicat softening point of 128° C., a melting point of 137° C. and an elongation at breakage (ASTM D-638) of 387%, 0.1 wt. % of a hindered phenolic antioxidant of pentaerythrityl-tetrakis[3-(3,5-di-t-butyl-4-hydroxyphenyl)propionate]methane, 0.05 wt. % of a phosphorus-containing antioxidant at tris(2,4-di-t-butylphenyl)phosphite, 0.2 wt. % of an organic nucleating agent of 1.3,2.4-di(para-methylbenzylidene)sorbitol ("Gel All MD", New Japan Chemical), 0.1 wt. % of calcium stearyl lactate and 0.05 wt. % of erucic amide as lubricant. 1 wt. % of oil furnace carbon black having a mean particle size of 21 μm, a pH of 8.0, an oil absorption value of 87 ml/100 g, a sulfur content of 0.3 wt. % and a volatile component content of 0.3 wt. % of which the surface was coated with 0.2 wt. % of zonc stearate, and 0.2 wt. % of A-type zeolite.

Using the above resin composition, container bodies for a photographic film shown in FIG. 1 were formed by using a toggle type injection molding machine ("NESTAL", Sumitomo Heavy Industries) with a hot runner type mold having a number of cavities of 24 at a mold clamping pressure of 150 t at a resin temperature of 200° C.

The inner surface was roughened by forming longitudinal ribs 0.25 μm in height, and the outer surface was roughened by forming lattice ribs 0.15 μm in height.

In the container body of this example, the dispersibility of carbon black was improved, and photographic properties of photographic photosensitive materials were excellent, e.g. rare occurrence of fogging, small sensitivity deviation, etc. Moreover, light-shielding ability was excellent, and coloring troubles did not occur at all. The occurrence of lumps was rare. Fatal molding troubles did not occur, and unmanned continuous injection molding was possible for a long period. The appearance of the molded container bodies was excellent. Buckling and bottom sink mark did not occur, and sound did not occur at the time of extracting the core from the container body.

Properties of the above examples and comparative examples are shown in Table 1.

TABLE 1

| | Example 1 | Comparative 1 | Comparative 2 | Example 2 | Example 3 | Example 4 | Example 5 | Test Method |
|---|---|---|---|---|---|---|---|---|
| Structure & Composition of Container | | | | | | | | |
| Structure of container | FIG. 1 | FIG. 1 | FIG. 1 | FIG. 3 | FIG. 1 | FIG. 1 | FIG. 1 | — |
| Composition of Container Body | PP resin contg. lubricating material | PP resin contg. lubricating material | PP resin not contg. lubricating material | L-LDPE resin contg. lubricating material | PP resin contg. lubricating material & light-shielding material | PP resin contg. lubricating material & light-shielding material | PP resin contg. lubricating material & light-shielding material | — |
| Composition of Cap | LDPE resin contg. lubricating material | LDPE resin contg. lubricating material | LDPE resin lubricating material | L-LDPE resin contg. lubricating material | LDPE resin contg. lubricating material | LDPE resin contg. lubricating material | LDPE resin contg. lubricating material | — |
| Structure of Container Body | | | | | | | | |
| Relation between Body and Cap | separated different resin between body and cap | separated different resin between body and cap | separated different resin between body and cap | integrated same resin composition | separated different resin between body and cap | separated different resin between body and cap | separated different resin between body and cap | — |
| Form & Height of Roughness Inner Peripheral Wall | | | | | | | | |
| Form | circumferential | circumferential | circumferential | lattice | longitudinal | lattice | circumferential | *1 |
| Height | 0.1 μm | less than 0.001 μm | less than 0.001 μm | 0.1 μm | 0.8 μm | lateral rib 0.2 μm longitudinal rib 0.55 μm | 0.3 μm | *2 |
| Form & Height of Roughness on Outer Peripheral Wall | | | | | | | | |
| Form | circumferential | circumferential | circumferential | lattice | lattice | circumferential | circumferential | *1 |
| Height | 0.1 μm | less than 0.001 μm | less than 0.001 μm | 0.5 μm | both of lateral rib longitudinal rib 0.03 μm | 0.1 μm | 0.3 μm | *3 |
| Container Properties | | | | | | | | |
| Appearance of container Body (Abrasion) | Transparant A | Abrasion occasionally D | Abrasion frequently E | B | White A | Silver A | Transparent A | *4 |
| Resistance to Buckling of Container Body | A | C | D | B | A | A | B | *5 |
| Prevention of Bursting Sound | A | C | E | B | A | A | A | *6 |
| Bottom Sink Mark | B | D | E | B | B | B | B | *7 |
| Insertion of Film Cartridge into Container | A | B–D | D | B | A | A | A | *8 |
| Insertion of Container into Decorated casket | A | B | D | B | Decorated casket not necessary A | A | A | *9 |
| Prevention of Bridging of container Bodies in Hopper | A | C | E | B | Body-cap integral type — | A | A | *10 |

| | Example 6 | Comparative 3 | Example 7 | Example 8 | Example 9 | Example 10 | Example 11 | Example 12 | Test Method |
|---|---|---|---|---|---|---|---|---|---|
| Structure & Composition of Container | | | | | | | | | |
| Structure of container | FIG. 3 | FIG. 3 | FIG. 1 | FIG. 1 | FIG. 1 | FIG. 1 | FIG. 1 | FIG. 1 | — |
| Composition of Container Body | PP resin contg. lubricating material & light-shielding material | PP resin | LDPE resin contg. light-shielding material | Polyethylene resin contg. lubricating material & light-shielding material | PP resin contg. lubricating material | PP resin contg. lubricating material | HDPE resin contg. lubricating material | HDPE resin contg. lubricating material & light-shielding material | — |
| Composition of Cap | PP resin contg. | PP resin | LDPE resin | LDPE resin | LDPE resin | LDPE resin | LDPE resin | LDPE resin | — |

TABLE 1-continued

| | | | | | | | | | |
|---|---|---|---|---|---|---|---|---|---|
| | lubricating material & light-shielding material | | contg. lubrication material & light-shielding material | contg. lubricating material & light-shielding material | contg. lubricating material & light-shielding material | contg. lubricating material & light-shielding material | contg. lubricating material | contg. lubricating material | |
| Structure of Container Body | | | | | | | | | |
| Relation between Body and Cap | integrated same resin composition | integrated same resin composition | separated different resin between body and cap | separated different resin between body and cap | separated different resin between body and cap | separated different resin between body and cap | separated different resin between body and cap | separated different resin between body and cap | — — |
| Form & Height of Roughness Inner Peripheral Wall | | | | | | | | | |
| Form | longitudinal | longitudinal | longitudinal | londitudinal | longitudinal | longitudinal | longitudinal | longitudinal | *1 |
| Height | 0.2 μm | less than 0.001 μm | 0.15 μm | 1.0 μm | 0.25 μm | 0.25 μm | 0.35 μm | 0.25 μm | *2 |
| Form & Height of Roughness on Outer Peripheral Wall | | | | | | | | | |
| Form | longitudinal | longitudinal | None | longitudinal | londitudinal | longitudinal | longitudinal | lattice | *1 |
| Height | less than 0.001 μm | less than 0.001 μm | — | 1.0 μm | 0.15 μm | 0.15 μm | 0.20 μm | both of lateral rib longitudinal rib 0.15 μm | *3 |
| Container Properties | | | | | | | | | |
| Appearance of container Body (Abrasion) | White, whitening slightly occurred B | Abrasion occurred, whitening transparency inferior X | Black A | White A | Transparent B | Transparent A | Transparent B | Black A | *4 |
| Resistance to Buckling of Container Body | A | C | A | A | A | A | A | A | *5 |
| Prevention of Bursting Sound | A | E | A | A | A | A | A | A | *6 |
| Bottom Sink Mark | B | D | B | B | B | B | A | A | *7 |
| Insertion of Film Cartridge into Container | A | C | A | A | A | A | A | A | *8 |
| Insertion of Container into Decorated casket | A | C | B | A | A | A | A | A | *9 |
| Prevention of Bridging of Container Bodies in Hopper | Body-cap integral type — | Body-cap integral type — | A | A | A | A | A | A | *10 |

Evaluations in Table 1 are as follows:
A Outstanding
B Excellent
C Practical
D Having a problem (Improvement is necessary)
E Impractical
*1 Observed by a metallugical microscope (Nikon).
*2 Height of roughness on the inner surface of the peripheral wall portion of the container body. The difference between the uppermost and the lowermost was measured using a tracer surface roughness tester ("surfcom 550 A", Tokyo Seimitsu) in a measuring distance of 5 mm at three positions, and a mean value was calculated.
*3 Height of roughness on the outer surface of the peripheral wall portion of the container body. The difference between the uppermost and the lowermost was measured using a tracer surface roughness tester ("surfcom 550 A", Tokyo Seimitsu) in a measuring distance of 5 mm at three positions, and a mean value was calculated.
*4 Appearance of container body. The container body formed by injection molding was evaluated by visual observation as to uniformity, attractiveness, abrasion, whitening and the like.
*5 Resistance to buckling of container body. Deformation immediately after injection molding was evaluated by visual observation.
*6 Prevention of bursting sound from container body. Sound generated at the time of extracting the core from the container body was heard by ear, and evaluated.
*7 Bottom sink mark. Cinnabar red seal ink was adhered to the bottom of the container body, and stamped on a white paper. The stamped form was evaluated by visual observation, and the greater the stamped area was, the less the bottom sink was.
*8 Insertion of photographic film cartridge into container. Evaluated by the inclination capable of entering the photographic film cartridge completely into the container body. Smaller inclination is better.
*9 Insertion of container into decorated casket. Evaluated by the inclination insertable into a constructed decorated casket, and by the generation degree of paper powder.
*10 Prevention of bridging of container bodies in hopper. 2,000 pieces of the container body were put in the container body hopper, and dropped through a round hole 10 cm in diameter with vibration, and evaluated by the degree of easiness of dropping.

We claim:

1. A container for a photographic film having a body made of thermoplastic resin, said body comprising an open-ended portion and a wall portion, said open-ended portion having a lip, said wall portion having an inner surface, wherein said inner surface possesses a roughened area having a variation in height of 0.001 to 5 μm.

2. The container of claim 1, wherein said rim of said open-ended portion is provided with notches.

3. The container of claim 1 wherein the container body contains lubricating material.

4. The container of claim 1 wherein the container body contains at least one kind of light-shielding material.

5. The container of claim 1 wherein said container is colored by the masterbatch method.

6. The container of claim 1, 2, 3, 4 or 5, wherein the container body comprises a polyethylene resin composition comprising more than 50 wt. % of homopolyethylene resin, ethylene-α-olefin copolymer resin or a blend thereof having a melt flow rate of 5 to 80 g/10 minutes, a density of not less than 0.935 g/cm$^3$ and a bending rigidity of not less than 4,000 kg/cm$^2$, 0.01 to 2 wt. % of nucleating agent and 0.001 to 2 wt. % of antioxidant.

7. The container of claim 6, wherein the container body comprises a polyethylene resin composition containing 0.001 to 1 wt. % of phenolic antioxidant and 0.001 to 1 wt. % of phosphorus-containing antioxidant.

8. The container of claim 7, wherein the container body comprises a polyethylene resin composition comprising more than 50 wt. % of homopolyethylene resin, ethylene-α-olefin copolymer resin or a blend thereof having a melt flow rate of 5 to 80 g/10 minutes, a density of 0.941 to 0.985 g/cm$^3$, a bending rigidity of not less than 6,000 kg/cm$^2$, a Shore hardness of not less than 60D, a notched Izod impact strength at 23° C. of not less than 2.0 kg.cm/cm, a Vicat softening point of not less than 110° C. and a melting point of not less than 120° C., 0.01 to 2 wt. % of nucleating agent and 0.001 to 2 wt. % of antioxidant.

9. The container of claim 7, wherein the container body comprises a polyethylene resin composition comprising more than 50 wt. % of homopolyethylene, ethylene-α-olefin copolymer resin or a blend thereof having a melt flow rate of 5 to 80 g/10 minutes, a density of 0.941 to 0.985 g/cm$^3$ and a bending rigidity of not less than 6,000 kg/cm$^2$ and 0.01 to 5 wt. % in the total content of an eutectic crystal compound of a carboxylic acid having a number of carbon atoms of not less than 3 and a nitrogen-containing heterocyclic compound having amino group or hydroxyl group at α-position and an alicyclic carboxylic acid amide compound of divalent or polyvalent aliphatic amine.

10. The container of claim 9 wherein the container body comprises a polyethylene resin composition containing 0.001 to 1 wt. % of organic cyclic phosphorous compound.

11. The container of claim 2, wherein the notches have a mean depth of 0.001 to 5 μm.

12. The container of claim 1, 2, 3, 4 or 5, wherein a difference in specific gravity between the container body and the cap is not less than 0.1 g/cm$^3$.

13. The container of claim 1, 2, 3, 4 or 5, wherein a haze of the container body is not more than 70%.

14. The container of claim 1, 2, 3, 4 or 5 wherein the thermoplastic resin contains 0.001 to 5 wt. % of ultraviolet absorber.

15. The container of claim 1, 2, 3, 4 or 5 wherein the thermoplastic resin contains 0.001 to 5 wt. % of metallic soap.

16. The container of claim 1, 2, 3, 4 or 5 wherein the thermoplastic resin contains 1,000 to 10,000 ppm of radical scavenger.

* * * * *